US011167918B2

(12) United States Patent
Dunn et al.

(10) Patent No.: US 11,167,918 B2
(45) Date of Patent: Nov. 9, 2021

(54) FLEXIBLE PAIL

(71) Applicant: Munchkin, Inc., Van Nuys, CA (US)

(72) Inventors: Steven Bryan Dunn, Beverly Hills, CA (US); Sung Yun Chan, Pasadena, CA (US); Kevin Douglas Johnson, Tarzana, CA (US); Agnes Yena Lee, Los Angeles, CA (US)

(73) Assignee: Munchkin, Inc., Van Nuys, CA (US)

( * ) Notice: Subject to any disclaimer, the term of this patent is extended or adjusted under 35 U.S.C. 154(b) by 28 days.

(21) Appl. No.: 16/848,776

(22) Filed: Apr. 14, 2020

(65) Prior Publication Data

US 2020/0239227 A1 Jul. 30, 2020

Related U.S. Application Data

(63) Continuation-in-part of application No. 16/532,209, filed on Aug. 5, 2019, now Pat. No. 10,618,729, which is a continuation-in-part of application No. 16/217,425, filed on Dec. 12, 2018, now Pat. No. 10,618,727.

(60) Provisional application No. 62/688,795, filed on Jun. 22, 2018, provisional application No. 62/628,771, filed on Feb. 9, 2018, provisional application No. 62/597,782, filed on Dec. 12, 2017.

(51) Int. Cl.
*B65F 1/00* (2006.01)
*B65F 1/16* (2006.01)

(52) U.S. Cl.
CPC ..... *B65F 1/0073* (2013.01); *B65F 1/002* (2013.01); *B65F 1/1607* (2013.01); *B65F 2001/1653* (2013.01); *B65F 2001/1676* (2013.01); *B65F 2210/167* (2013.01); *B65F 2220/106* (2013.01)

(58) Field of Classification Search
CPC ..... B65F 1/0073; B65F 1/0053; B65F 1/002; B65F 1/0006; B65F 1/125; B65F 1/12; B65F 1/1607; B65F 1/16; B65F 1/1421; B65F 1/141; B65D 37/00; B65D 7/02
USPC ..... 220/9.3, 9.2, 9.1, 4.05, 4.08, 908.1, 908, 220/832, 831, 810, 495.08, 495.06, 666; 383/59, 84; 150/900
See application file for complete search history.

(56) References Cited

U.S. PATENT DOCUMENTS

| | | | | |
|---|---|---|---|---|
| 7,458,480 | B2 * | 12/2008 | Nguyen | B65F 1/02 220/666 |
| 8,066,137 | B2 | 11/2011 | Sanfilippo et al. | |
| 8,231,024 | B2 | 7/2012 | Sanfilippo et al. | |
| 8,602,244 | B2 | 12/2013 | Sanfilippo et al. | |
| 9,162,786 | B2 | 10/2015 | Sanfilippo et al. | |
| 9,622,628 | B2 | 4/2017 | Zawrotniak et al. | |

(Continued)

FOREIGN PATENT DOCUMENTS

| | | |
|---|---|---|
| WO | 2008055962 | 5/2008 |

*Primary Examiner* — Robert J Hicks
(74) *Attorney, Agent, or Firm* — Alan D. Borelli, Esq.; Robert Z. Evora, Esq.

(57) ABSTRACT

A flexible pail having a container that is adapted to stand upright. The container may have a flexible sheet, a cover, a base, a flap and an odor barrier. The cover may be attached to a first upper end of the flexible sheet, while the base may be attached to a second lower end of the flexible sheet. The cover may have a flap pivotably attached thereto, such that the flap is adapted to pivot between an open position and a closed position. The cover may further have an opening and an odor barrier disposed in the opening.

20 Claims, 39 Drawing Sheets

(56) References Cited

U.S. PATENT DOCUMENTS

| | | | | |
|---|---|---|---|---|
| 2011/0101014 | A1* | 5/2011 | Conrad | B65F 1/06 220/810 |
| 2012/0234849 | A1* | 9/2012 | Hughes | B65F 7/00 220/810 |
| 2014/0083897 | A1 | 3/2014 | Sanfilippo et al. | |
| 2014/0109522 | A1 | 4/2014 | Sanfilippo et al. | |

* cited by examiner

FLEXIBLE PAIL

CROSS REFERENCE TO RELATED APPLICATIONS

This Continuation-in-part application incorporates and claims the benefit of the filing date of U.S. patent application Ser. No. 16/217,425, entitled "FLEXIBLE PAIL" filed Dec. 12, 2018; U.S. patent application Ser. No. 16/532,209 entitled "FLEXIBLE PAIL" filed Aug. 5, 2019; U.S. Provisional Patent Application Ser. No. 62/688,795, entitled "FLEXIBLE PAIL" filed Jun. 22, 2018; and U.S. Provisional Patent Application Ser. No. 62/628,771, entitled "FLEXIBLE PAIL" filed Feb. 9, 2018; and U.S. Provisional Patent Application Ser. No. 62/597,782, entitled "FLEXIBLE PAIL" filed Dec. 12, 2017, the entirety of which are incorporated herein by reference.

TECHNICAL FIELD

The subject disclosure relates to a waste disposal system. More specifically, to a flexible pail having substantial rigidity to enable the flexible pail to stand upright. The flexible pail having various applications, e.g., infant diapers and disposable adult undergarments, pet waste disposal and the like.

BACKGROUND

Traditional waste pails are generally inflexible, bulky, rigid and cumbersome. Furthermore, these waste pails are not compact or readily portable. Thus, a need arises for parents, caregivers and pet owners who want to have alternate solutions to easily tote a waste disposal pail with them on the go and/or have multiple compact waste pails throughout the house.

SUMMARY

A flexible pail having a container that is adapted to stand upright. The container may have a flexible sheet, a cover, a base, a flap, an odor barrier. The cover may be attached to a first upper end of the flexible sheet, while the base may be attached to a second lower end of the flexible sheet. The cover may have a flap pivotably attached thereto, such that the flap is adapted to pivot between an open position and a closed position. The cover may further have an opening and an odor barrier disposed in the opening. The flexible pail is adapted to compress to a very small volume and expand into a large container.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of the present invention will now be described in greater detail with reference to the figures.

Figure 1:
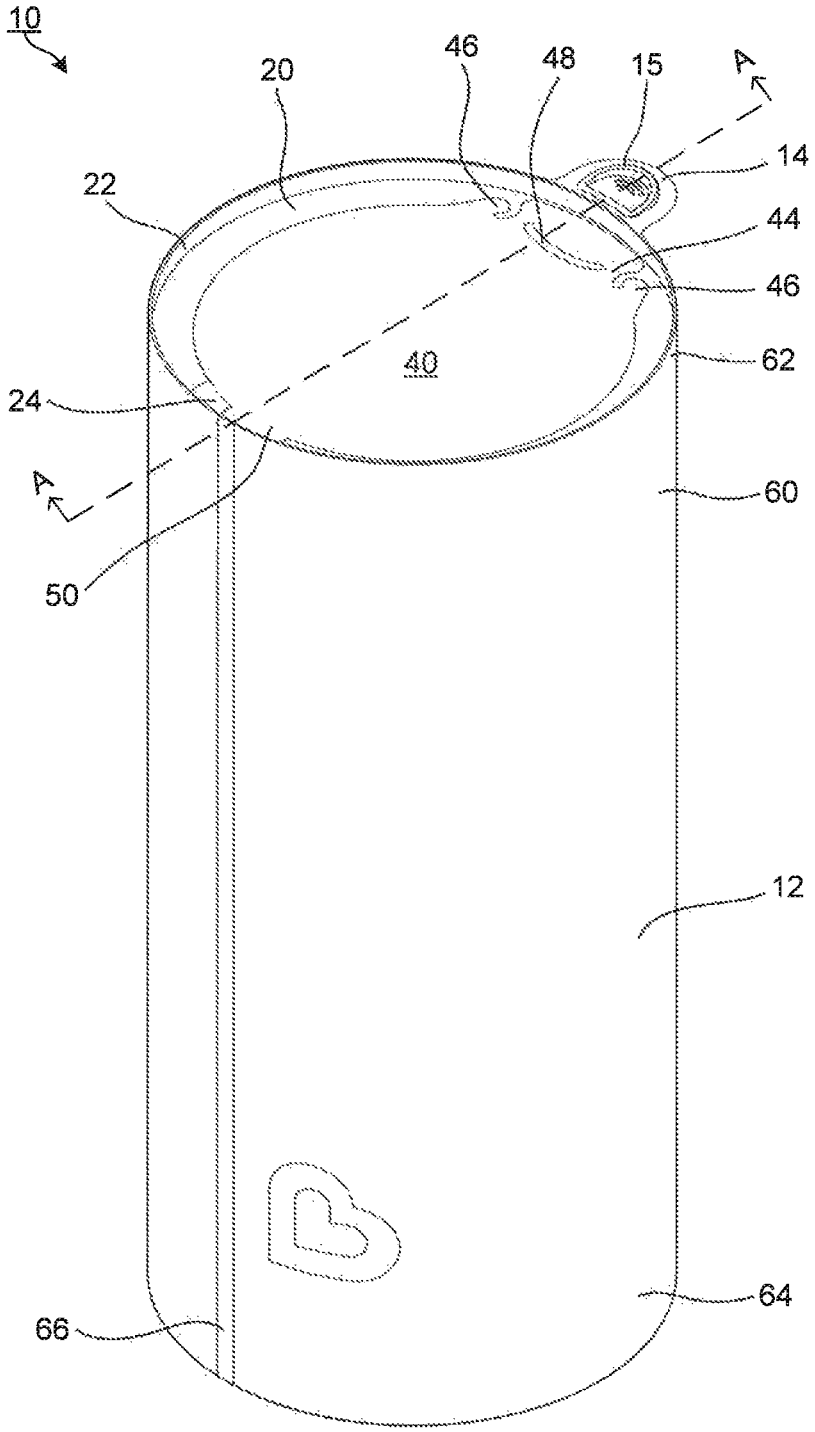
FIG. 1 illustrates a top perspective view of a flexible pail in a closed configuration according to the subject disclosure.

FIG. 1 illustrates a flexible pail 10 in a closed position adapted to stand upright. The flexible pail 10 may have a cover 20, a lid or flexible cover flap 40, a container body 60 and a base 80 (as shown in FIG. 3).

The flexible pail 10 can be sleek, compact and lightweight. Furthermore, the flexible pail 10 may be lower in cost and disposable. Therefore, the flexible pail 10 may be ideal for many different situations. For example, the lightweight and portable nature of the flexible pail 10 allows users to put the flexible pail in any given room and simultaneously provides users with the ability to take the flexible pail 10 with them on the go.

In other situations, parents, caretakers and/or pet owners may leave their children, pets or dependents with grandparents or caretakers who may not have a traditional pail. The flexible pail 10 then would provide caretakers with the simplicity and affordability of bringing the flexible pail 10 to others taking care of a dependent individual or animal such that another caretaker will also benefit from the use of the flexible pail 10 to assist in preventing the emanation of foul odors from the lack of an odor-proof flexible pail. Due to the affordability and disposability of the flexible pail 10, the caretakers need not return the flexible pail 10.

Figure 2:
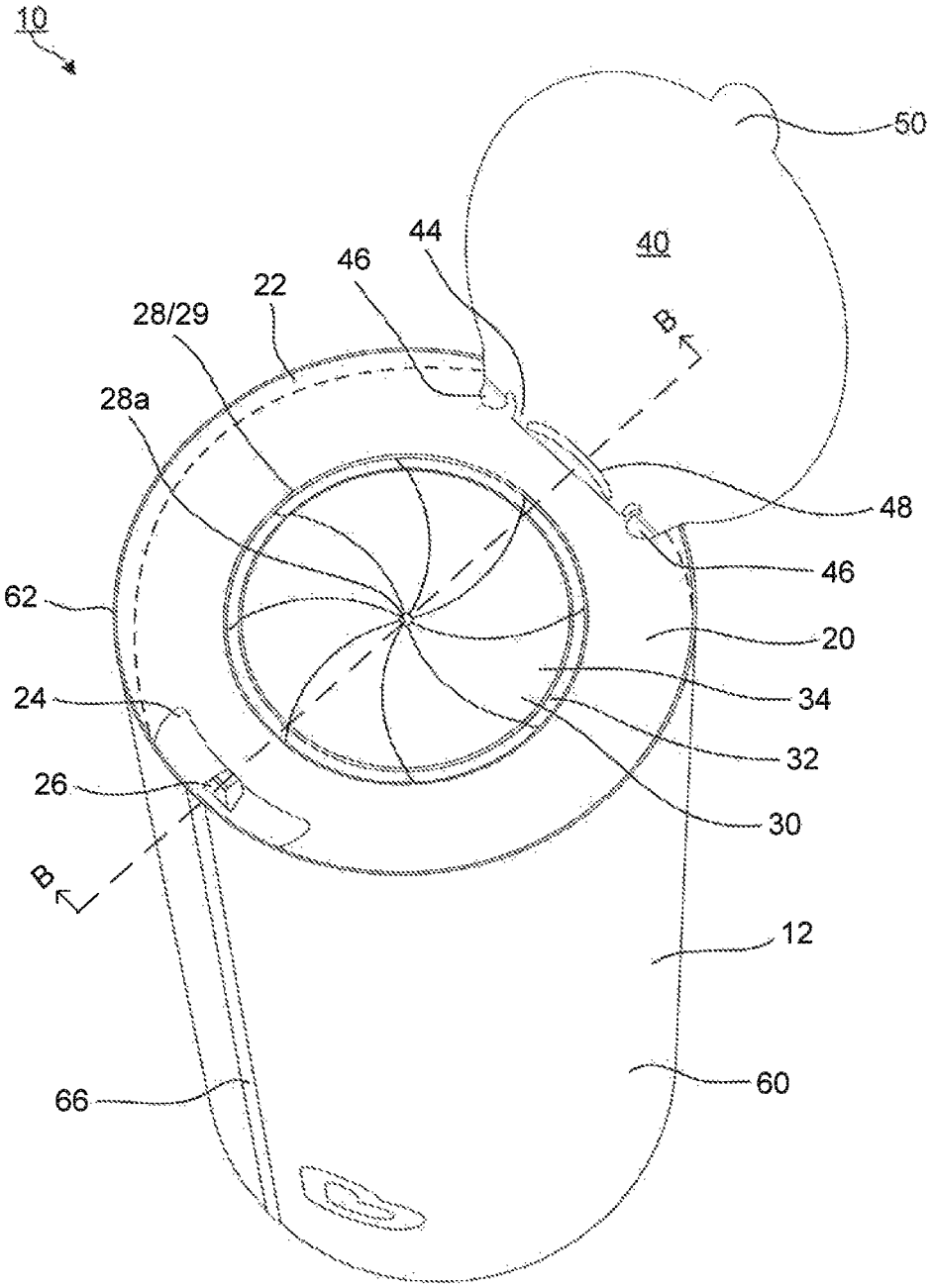
FIG. 2 is a top perspective view of the flexible pail in an open configuration.
Figure 3:
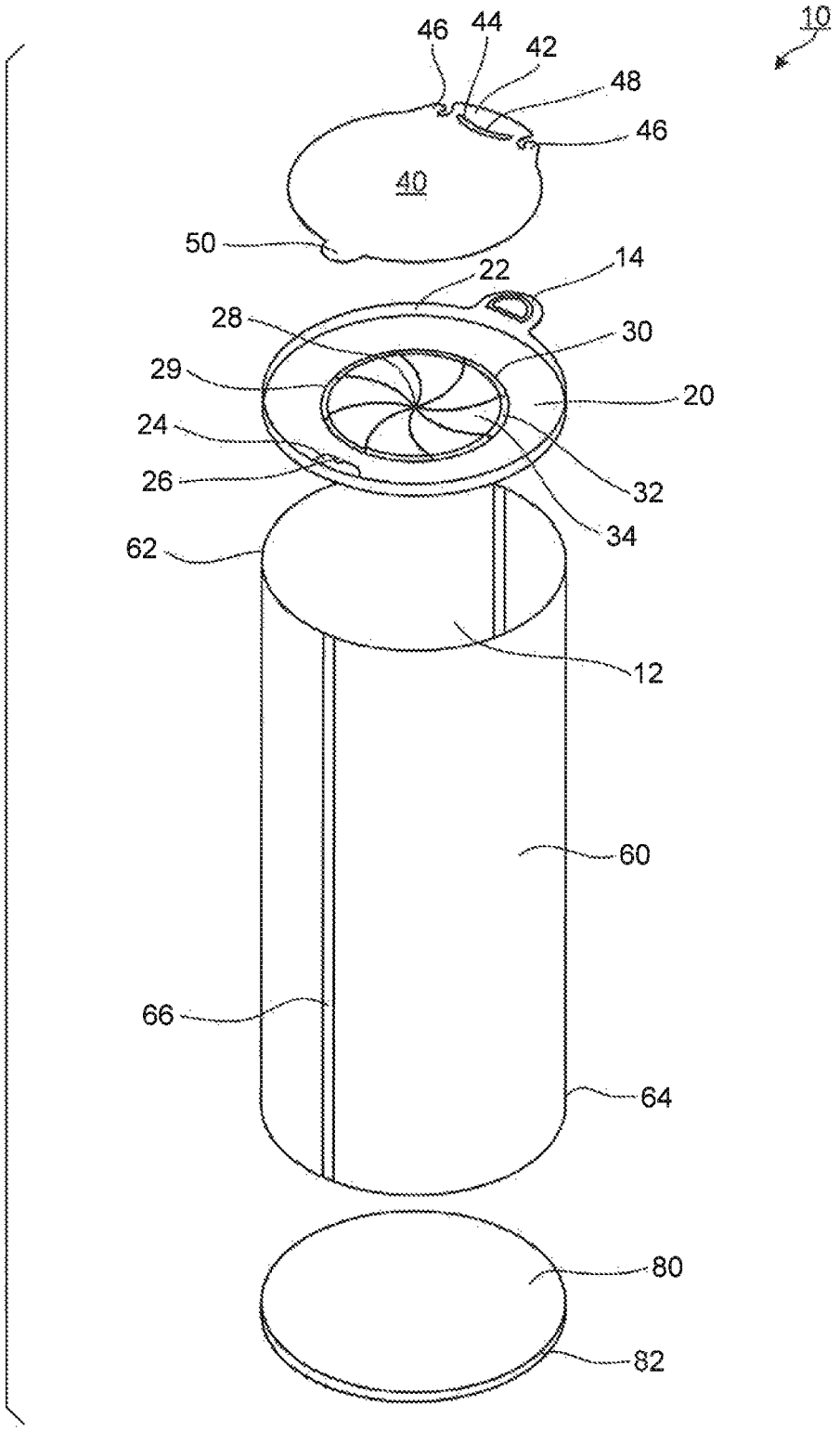
FIG. 3 is an exploded view of the flexible pail.

As further shown in FIGS. 1-3, the cover 20, the lid 40, the container body 60 and the base 80 work together to form a re-closable chamber 12, into which waste may be placed. The cover 20, the lid 40, the container body 60 and the base 80 also prevent waste odor from within the chamber or compartment 12 from reaching or emanating outside of the flexible pail 10. To achieve this, the cover 20 may be vacuum formed or bonded at a first upper end 62 of the container body 60. Similarly, the base 80 may also be vacuum formed at a second lower end 64 of the container body 60.

The cover 20 can be constructed or bonded by vacuum form or any other suitable method of manufacture for developing the semi-rigid cover 20. Furthermore, the cover 20 or any other portion of the flexible pail 10, such as the container body 60, lid 40 or base 80, can be constructed of any suitable material that prevents unpleasant smelling odorous gases from leaking through the material of the flexible pail 10, including but not limited to polyethylene, plastics, woven polypropylene plastic, paperboard, polyester, mixed plastics, corrugated fiberboard, paperboard, mat board, carton board, plastic lined paper, aluminum coated paper, metalized film, rubber, metal, wood, thick fabrics and the like, or any combination of the above, which are capable of compressing into a compact flexible pail 10.

As shown in FIGS. 1-3 and 9-10, the cover 20 may have a cover lip 22. The cover lip 22 is disposed at distal edges of the cover 20 and can be used to attach the cover 20 to the first upper end 62 of the container body 60. Although shown as facing upwards and away from the container body 60, it is to be understood that the cover lip 22 may also be facing generally downwards and toward the container body 60 or any other suitable orientation that assists in attaching the cover 20 to the container body 60.

As stated above, the semi-rigid cover 20 is attached to the first upper end 62 of the container body 60. This can be achieved by using the cover lip 22 and applying a heat sealing process between the cover lip 22 and the first upper end 62. However, it is to be understood that the semi-rigid cover 20 may be fastened to the upper end 62 of the container body 60 in a variety of diverse ways, such as but not limited to, an adhesive, a bonding agent, material welding, an/or any other suitable method for attaching the cover 20 to the upper end of the container body 60.

Figure 9:
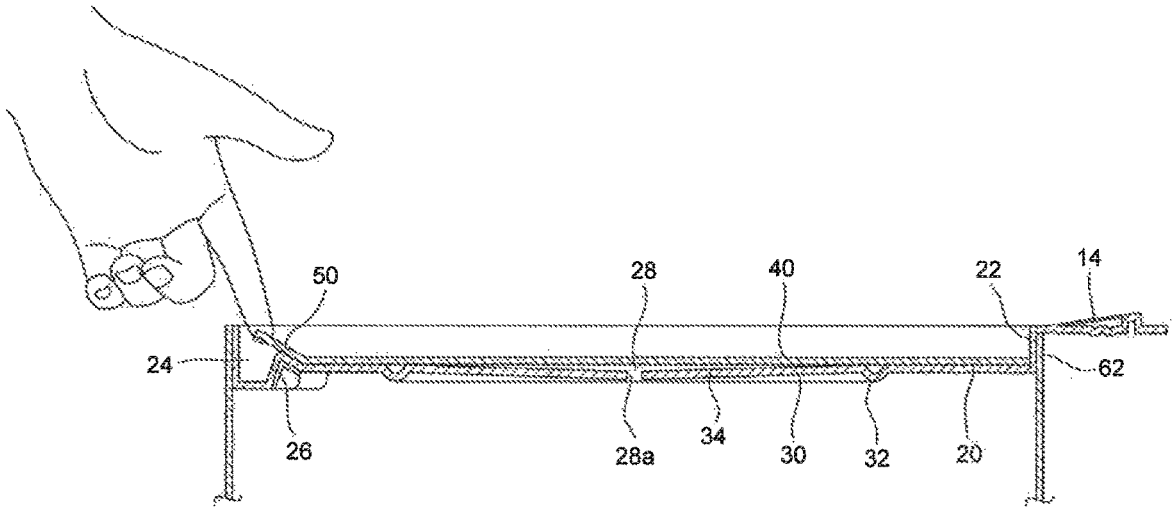
FIG. 9 is a partial cross-section view along A-A in FIG. of the flexible pail in the closed configuration.
Figure 9A:
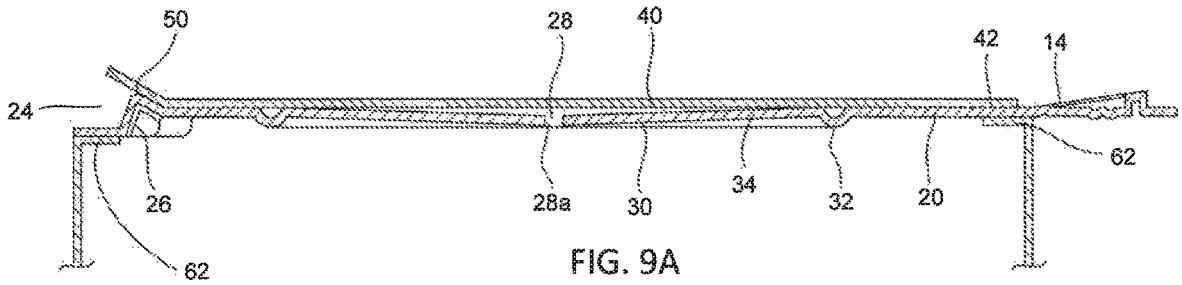
FIG. 9A is a partial cross-section view of the flexible pail without a cover lip.
Figure 9B:
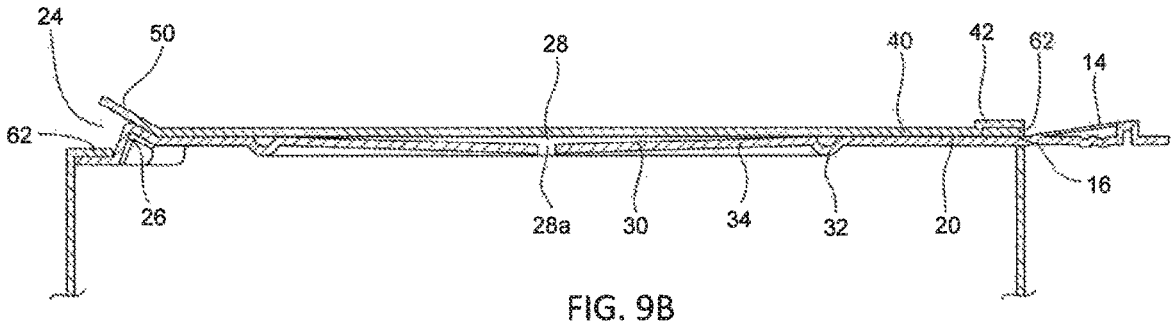
FIG. 9B is a partial cross-section view of a second configuration of the flexible pail without a cover lip.

FIGS. 9A-9B contemplate that the cover 20 need not have the cover lip 22 attached to the first upper end 62 of the container body 60. As shown, the first upper end 62 of the container body 60 may sit below (FIG. 9A) or above (FIG. 9B) the cover 20 and may be bonded to distal edges of the cover 20.

FIG. 9B further contemplates that the first upper end 62 may have a hole 16 through which a tab 14 may sit therethrough. The removal of the cover lip 22 allows for the flexible pail 10 to be compressed into an even smaller, flatter unit. In both instances, the first upper end 62 of the container body 60 may be formed into a plurality of inward facing tabs so that they may be folded inwards without overlapping and be directly bonded to the cover 20.

FIGS. 1-3 and 9-10 illustrate the cover 20 may further have a finger recess 24 that allows a user to more easily remove the lid 40. Similarly, multiple finger recesses 24 can be designed onto the cover 20 such that the user may easily remove the lid 40 from the cover 20. It is to be understood that the finger recess 24 can be sized and positioned in any suitable shape, size and/or orientation that allows a user to easily remove the lid 40 from the cover 20.

FIGS. 1-3 and 9-10 show the cover 20 may further have a cover bump or protrusion 26 that may be slightly raised or elevated above the surface of the cover 20. The cover protrusion 26 provides a similar function as the finger recess 24. In other words, the cover protrusion 26 assists a user in easily removing the flap 40 from the cover 20 by slightly raising the flap to above the cover 20. Although shown disposed within the finger recess 24, it is to be understood that the cover protrusion 26 may be disposed on any suitable surface of the cover 20 to allow a user to easily grasp the flap 40 and remove it from the cover 20 regardless of whether the cover 20 has a finger recess 24 or not. Similarly, the protrusion 26 may be of any suitable shape, size and/or orientation that allows the user to easily remove the flap 40 from the cover 20.

FIGS. 2-3 and 9-10 show that the semi-rigid cover 20 has an opening 28 adapted to receive waste therein. The opening 28 may be positioned centrally in the cover 20 such that waste or other material moving through the opening 28 moves from outside of the flexible pail 10 to the inner storage compartment 12 inside of the flexible pail 10. More specifically, the material moving through the opening 28 may be deposited into an open volume within the chamber 12.

FIGS. 2-3 and 9-10 demonstrate that the opening 28 may be configured to include a barrier 30 to help keep the odor within the compartment 12 and prevent the odor from reaching the outside of the flexible pail 10. The barrier may be made of a similar material as the cover 20, or a different material for a different level of flexibility.

The barrier 30 may have a finger or plurality of fingers 34 that, in a first position, restrict the total open area of the opening 28 to form a smaller opening 28*a*, through which material may pass through. The plurality of fingers 34 extend radially inward from an edge 29 of the opening 28 to the smaller opening 28*a* at approximately a center of the opening 28.

The barrier 30 may also be formed as a single flap of material (not shown) or several overlapping layers of material that act to prevent the escape of malodor from the compartment 12. The barrier 30 may be formed as a single slit in an otherwise uninterrupted sheet of material. Furthermore, the fingers 34 of the barrier 30 may be of any size, or of any number, to both prevent the release of malodor and allow the user to penetrate the seal formed by the barrier 30 in order to access the compartment 12.

Figure 10:
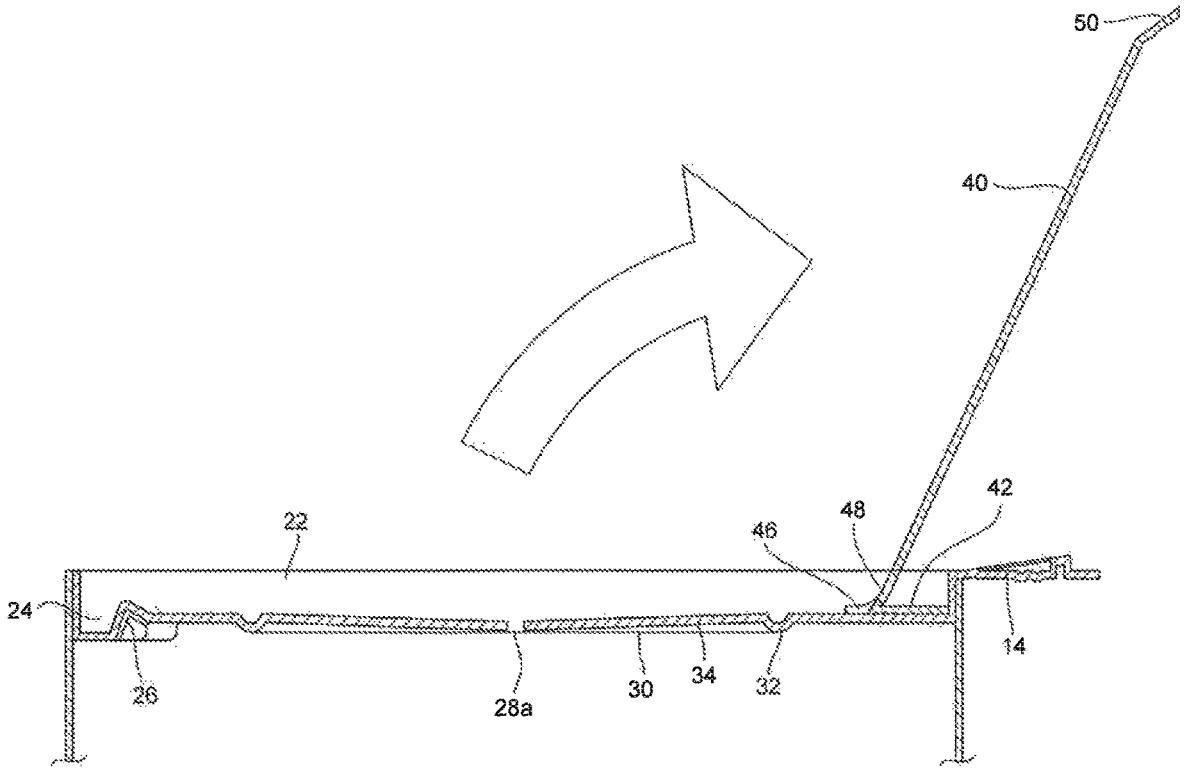
FIG. 10 is a partial cross-section view along B-B in FIG. 2 of the flexible pail in the open configuration.

FIG. 10 shows the addition of a barrier recess 32 in the barrier 30. This barrier recess 32 allows for additional strength and flexibility of the barrier 30 so that a user may more easily push through the barrier 30 to deposit waste into the compartment 12. The barrier recess 32 may be disposed at a base on the plurality of fingers 34 of the barrier 30. The barrier recess 32 adds strength and flexibility to the fingers 34 of the barrier 30. The barrier recess 32 or curve allows the fingers 34 to resiliently withstand more repetitive use across the barrier 30. The barrier recess 32 may also act as a spring to bias the barrier fingers 34 back upright into its original closed position after each use.

FIGS. 1-3 and 6-7 contemplate the cover 20 having the cover flap 40 attached. The cover flap 40 may be pivotally attached over the opening 28 in the cover 20. More specifically, the cover flap 40 may have a base 42 that is attached to the cover 20.

The flexible cover flap 40 on the semi-rigid cover 20 may be adapted to close over the opening when not in use. The flexible flap 40 may further have a resealable adhesive adapted to seal odor from the waste escaping through the opening 28 in the closed and sealed position. The resealable adhesive allows for the cover flap 40 to pivot between the closed and open positions. Although described with a resealable adhesive, it is to be understood that various other suitable methods (such as static charge, friction, magnetic closures, clips, clamps, screws, etc.) may be provided to seal the cover 20 and flap 40 and malodor from escaping through the opening 28 and the flap 40 according to this disclosure.

Operation of the cover flap 40 may be performed by a one-handed operation. In use, the cover flap 40 is pulled away from the opening 28 and a waste item is placed through the opening 28. The cover flap 40 may flexibly allow the waste item to be inserted through the opening 28. The user may then remove their hand from the cover flap 40 disposed over the opening 28. The cover flap 40 is then closed and the closure or adhesive located between the cover flap 40 and the cover 20 seal the cover flap 40 and the cover 20 to each other to form a tight seal to prevent unpleasant odors from escaping from within the compartment 12 of the flexible pail 10.

To facilitate the opening and closing of the cover flap 40, the cover flap 40 may also have a hinge 44 capable of holding itself in an open position, such that items can be inserted by a user into the opening 28 without interruption by the cover flap 40. The flexible cover flap 40 pivots about one side of the opening 28. However, it is to be understood that the cover flap 40 can be constructed in a variety of different methods, such as multiple cover flaps 40 that cover each other, each cover flap pivoting about a different side of the opening 28.

Referring back to FIGS. 2-3, the hinge 44 provides an axis, about which the cover flap pivots. Along the axis, the cover flap 40 may have a hinge aperture 48, which allows for greater flexibility of the cover flap 40. Furthermore, the aperture 48 allows for more surface area for the flap base 42 to attach to the cover 20. Due to the lack of material in the aperture 48, the cover flap 40 may then more easily pivot between the open and closed positions. Although not shown, it is further contemplated that a thinner portion can achieve a similar easing for the pivoting motion.

Figure 13:
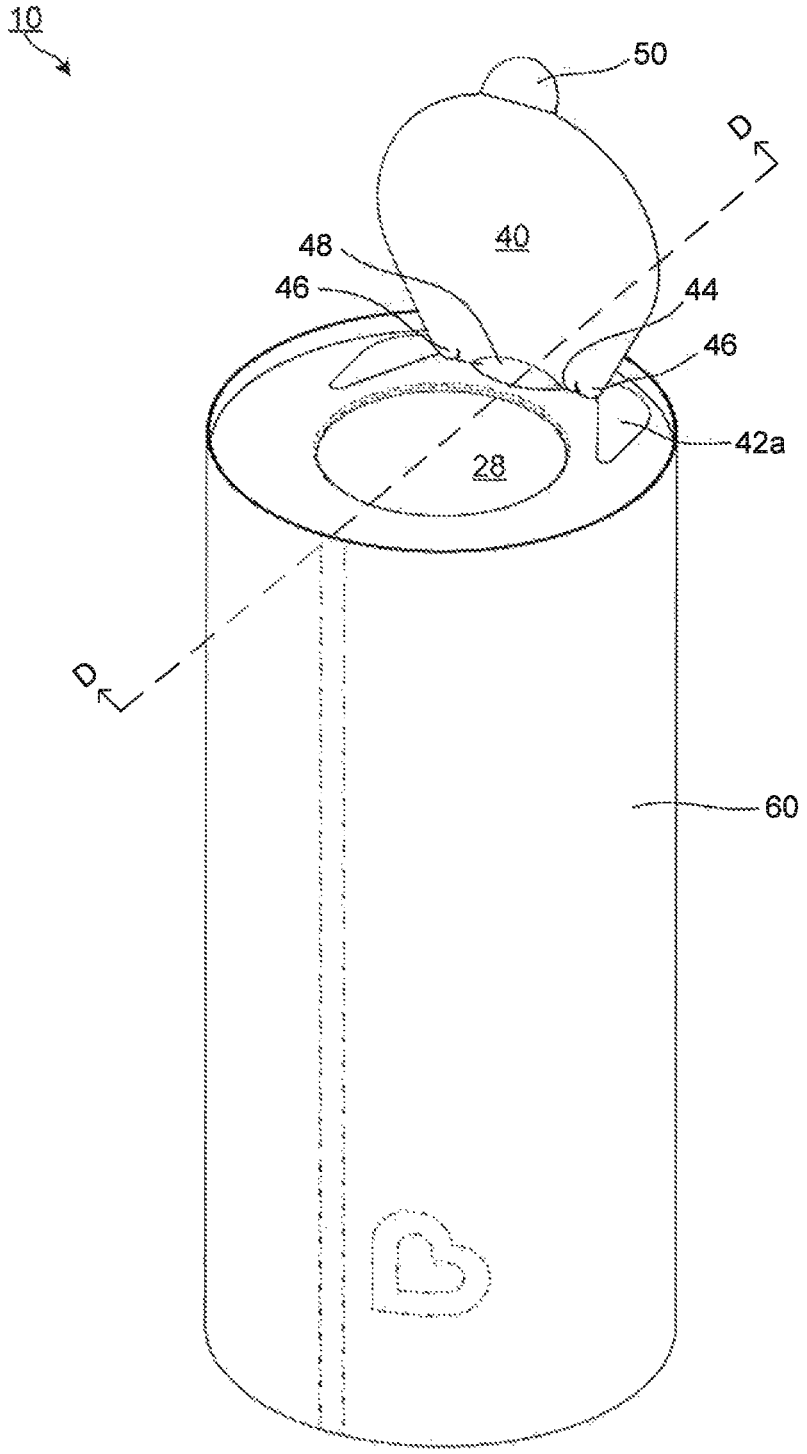
FIG. 13 is an upper perspective view of a third embodiment of the flexible pail.

FIGS. 2 and 10 show that the hinge 44 of the flexible cover flap 40 may be cut to form geometric protrusions or feet 46, which provide support for the flexible cover flap 40 to remain in the open position. When the flexible cover flap 40 is opened over approximately 90 degrees from the surface of the cover 20, the feet or geometric protrusions 46 are flipped forward (as shown in FIGS. 10 and 13) and biased against a top surface of the cover 20, thereby biasing the flexible cover flap 40 to remain open by holding it in place in an open position as shown. That is, the foot 46 is flipped forward and biased against the surface of the cover 20 to withstand the weight of the flexible cover flap 40 from being closed.

The open position then allows a user to insert items into the opening 28 without interruption by the cover flap 40 wanting to close as a result of gravity and its own weight.

When a user desires the flexible cover flap 40 to be closed, the user manually begins to close the flexible cover flap 40 and the feet or geometric protrusions 46 naturally flip from the forward position to a backward flipped position. That is, the geometric protrusions 46 that are pressed against the top surface of the cover 20 in a forward position are forced backwards as enough closing force is applied to the cover flap 40 for the geometric protrusions 46 to slide against the cover 20 and flip backwards to release the feet 46 and permit the cover flap 40 to pivot into the closed position of FIGS. 1 and 9.

To further assist opening and closing the flap 40, the flexible flap 40 may have a pull tab 50 to allow a user to easily open and close a flexible cover flap 40. More specifically, the tab 50 is constructed into the cover flap 40 to assist in pulling the cover flap away from the cover 20 to permit access to the opening 28. The tab 50 may also be angled upwards, as shown in FIGS. 9-10 for easier access thereto.

Figure 6:
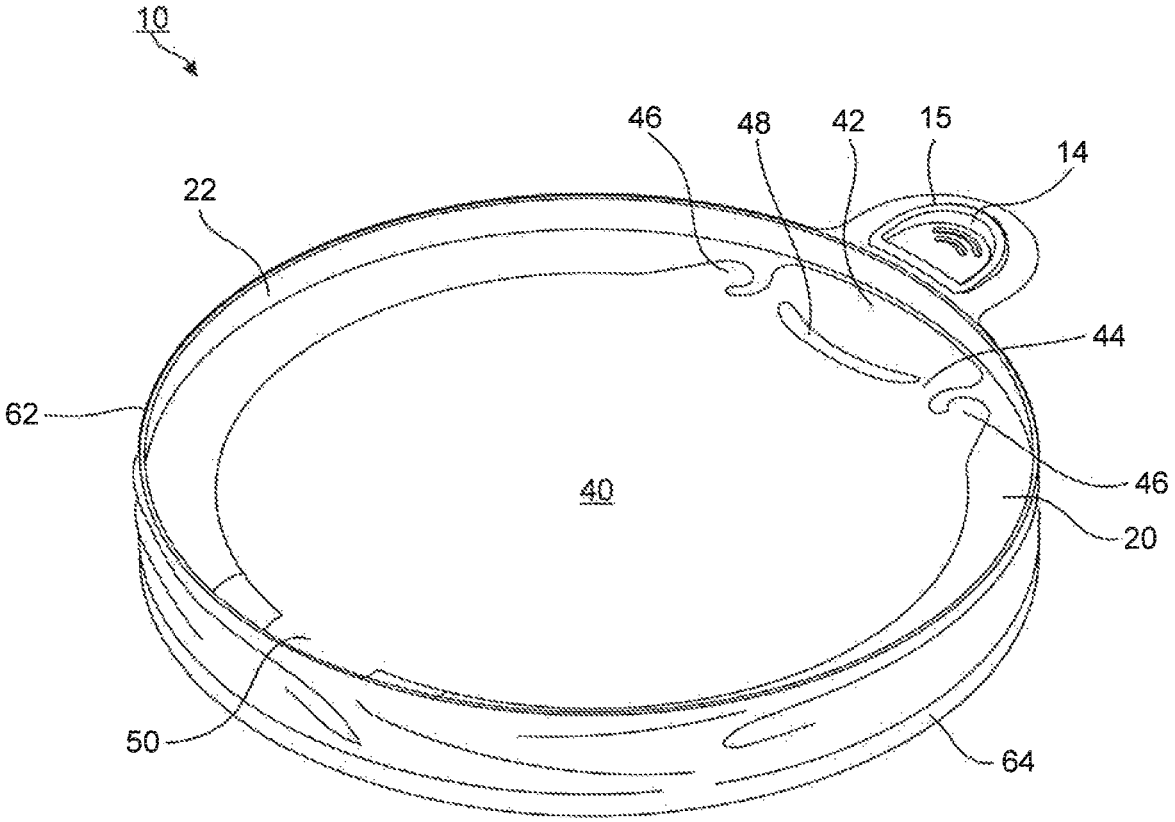
FIG. 6 is an upper perspective view of the flexible pail in a compact, compressed configuration.
Figure 7:
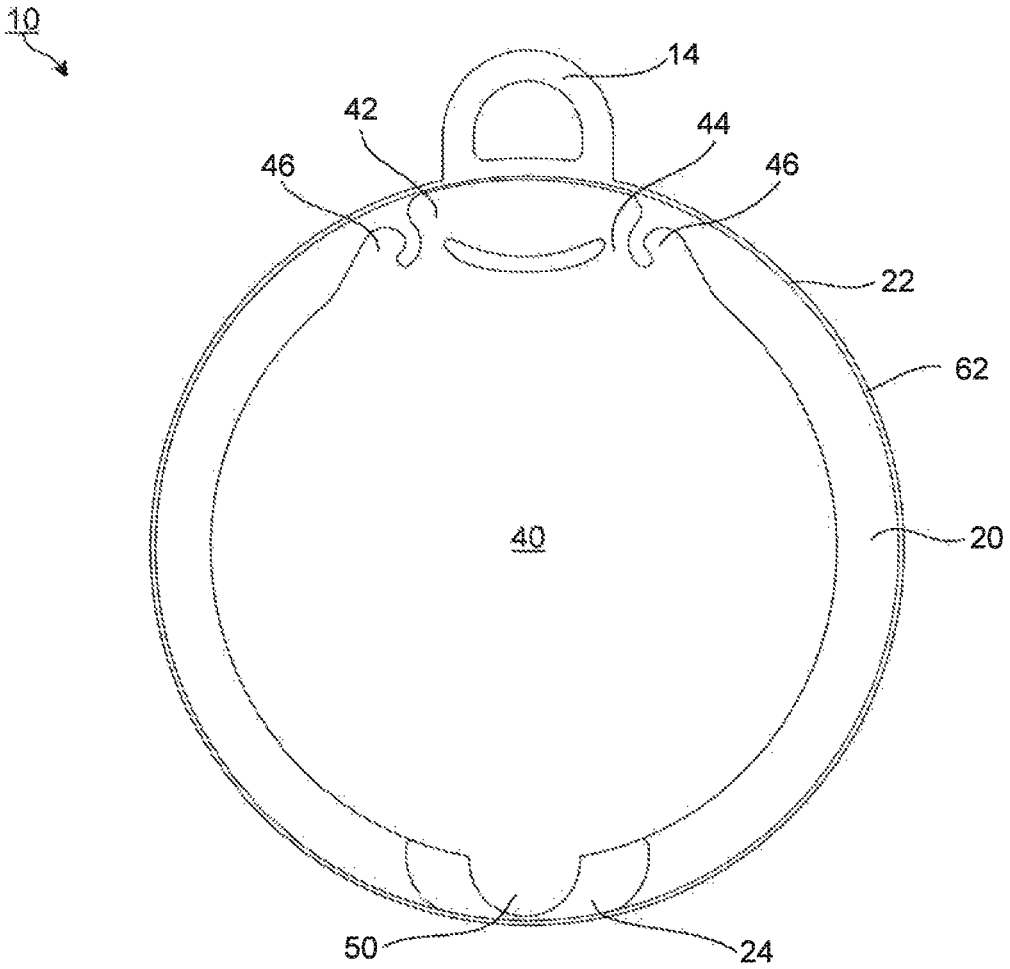
FIG. 7 is a top view of the flexible pail.

FIGS. 1-3 and 6 show the cover 20 is attached to the upper end 62 of the container body 60. The container body 60 is made from a flexible sheet having a generally cylindrical form. The flexible sheet of the container body 60 may be composed of a semi-rigid material capable of being stretched into an upright standing position (FIGS. 1-3) and/or compressed flat for storage (FIG. 6). The semi-rigid material of the container body is sufficiently strong enough to stand upright under its own weight. Likewise, the semi-rigid material of the container body 60 could maintain an upright position with the flexible pail 10 being filled to capacity with waste within its internal compartment. When empty, the flexible pail may weight as little as 1 ounce (28.3 grams). However, the embodiments depicted range between 2 and 3 ounces (approximately between 56.7 and 85 grams respectively). Larger versions of the flexible pail would necessarily weigh proportionally more than the current embodiments.

The flexible pail 10 can be compressed down to a very thin height. For example, a height in a range of 1 inch to less than approximately one eighth (⅛) of an inch, or fully extended to a height of 18 inches or more. The maximum height of the flexible pail 10 can be chosen by how much waste is desired to be placed in the compartment 12. For example, a height of approximately 18 inches can accommodate approximately 30 used newborn diapers or 12-24 adult diapers. The height range provides users with the flexibility of using the flexible pail 10 for as little as a single day or much longer, such as a week or longer. In other words, the height range of the flexible pail 10 provides an adaptable compartment 12, the volume of which varies with the height range. The changing volume or adaptable compartment 12 is able to accommodate as much or as little waste as the user desires until the compartment is full. The changing volume may accommodate a sizable range, for example from a height range of ⅛ inch to 18 inches. It is to be understood that the changing volume and compressibility and/or expansion of the flexible pail 10 may provide more or less of a height range as desired. The height range may be subject to various parameters, such as the construction of taller or longer lips 22, 82 of the cover 20 and the base 80 and/or thicker or more material for the flexible sheet.

Various materials may be selected according to this subject disclosure in order to yield the container body 60. Semi-rigid materials may be used to provide sufficient rigidity to keep the flexible pail 10 in an upright orientation during use and storage. The material selected may also be odor resistant. Deodorizers may be incorporated into this subject disclosure to prevent foul odors from emanating from within the flexible pail 10.

Figure 4:
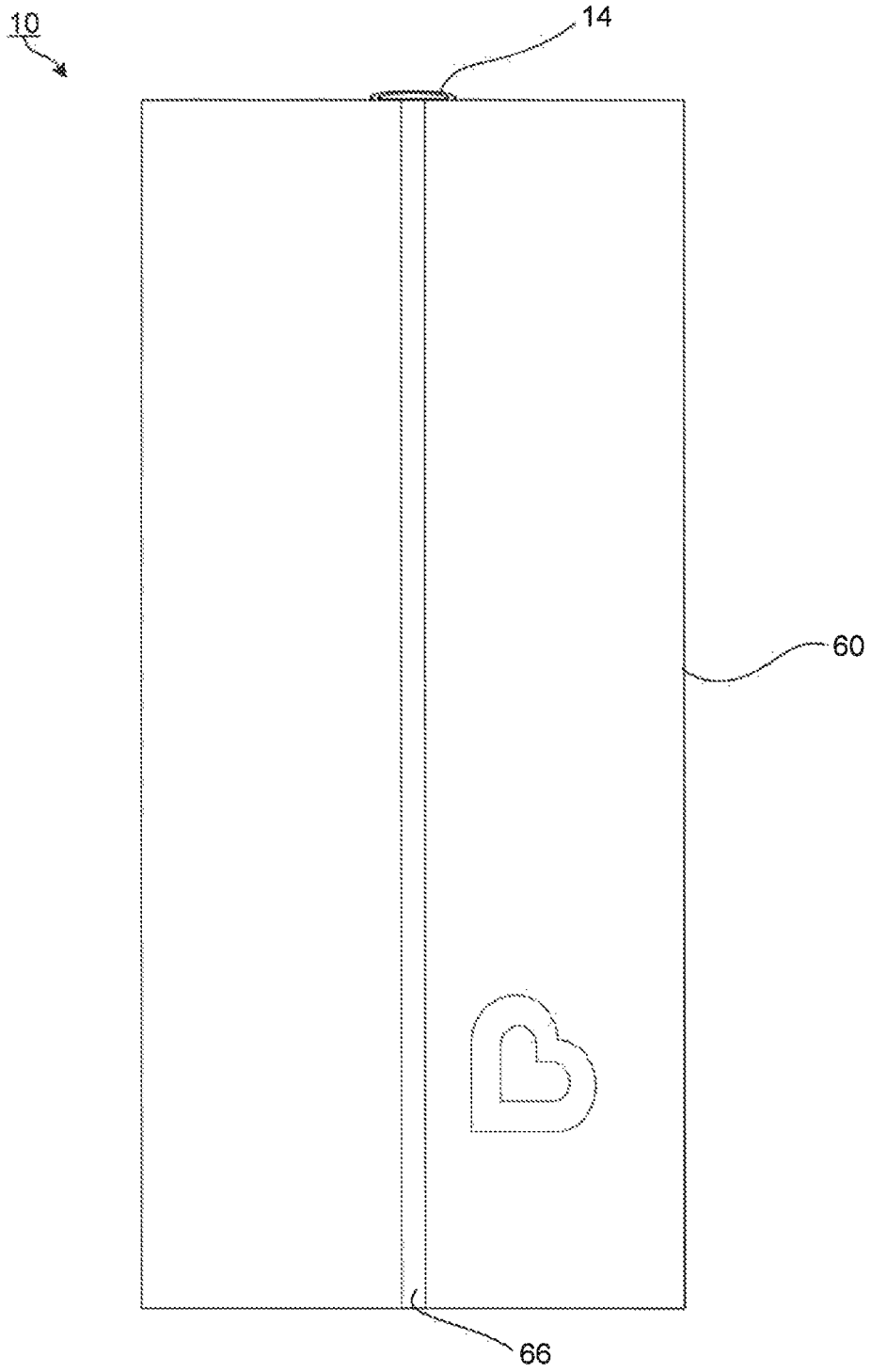
FIG. 4 is a front view of the flexible pail.
Figure 5:
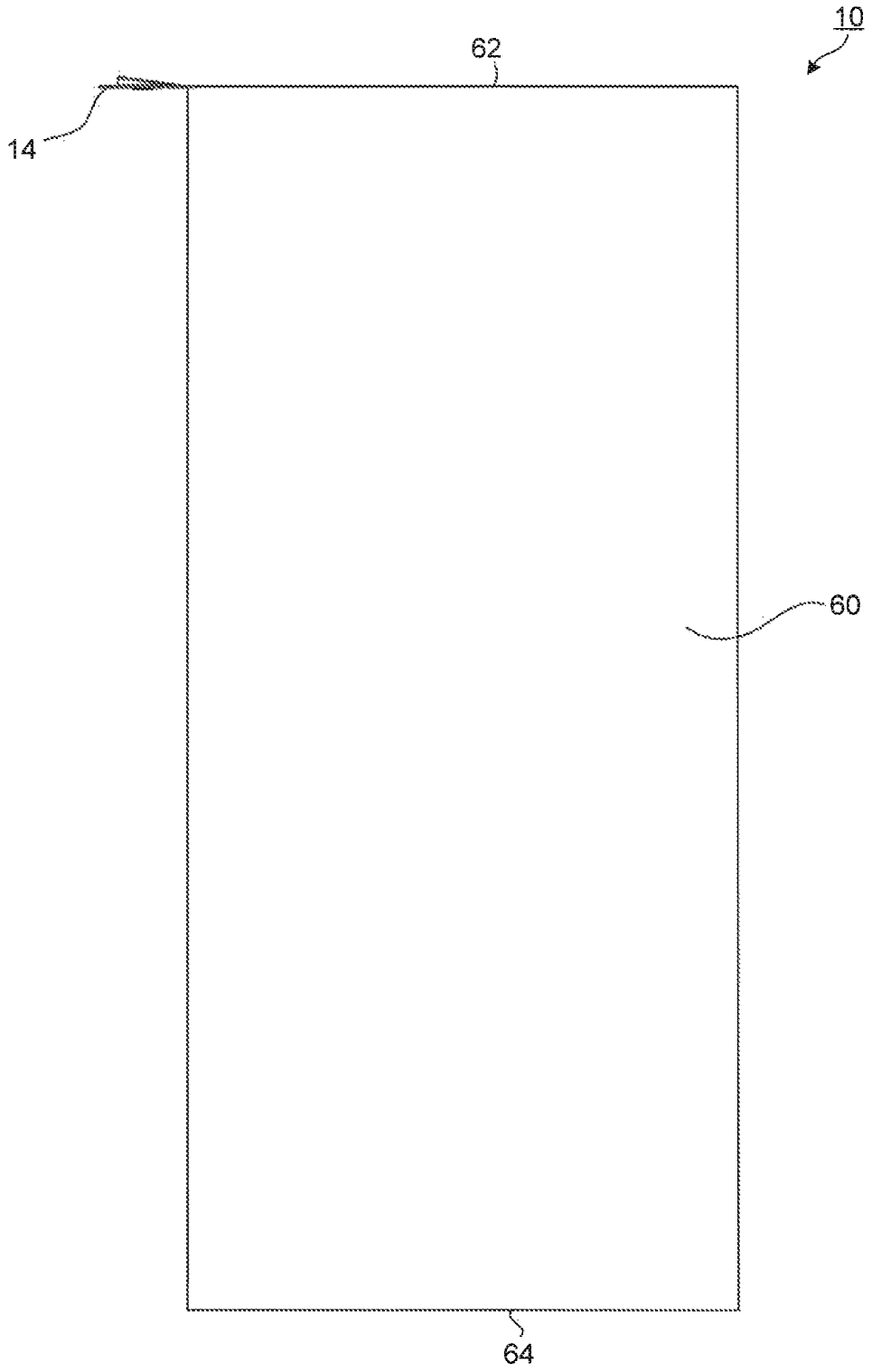
FIG. 5 is a side view of the flexible pail.

FIGS. 3-4 illustrate a transparent line 66 in the container body 60 along a portion or entirety of a length of the container body 60. The transparent line 66 allows a user to view and/or plan for the amount of space already used and the remaining capacity within.

The container body 60 may take a variety of different shapes. Although, embodied herein in cylindrical form, the container body 60 can take any suitable shape, such as a rectangular prism or any obtuse shape. Accordingly, the semi-rigid cover 20 and base 80 may have a complementary shape.

Figure 8:
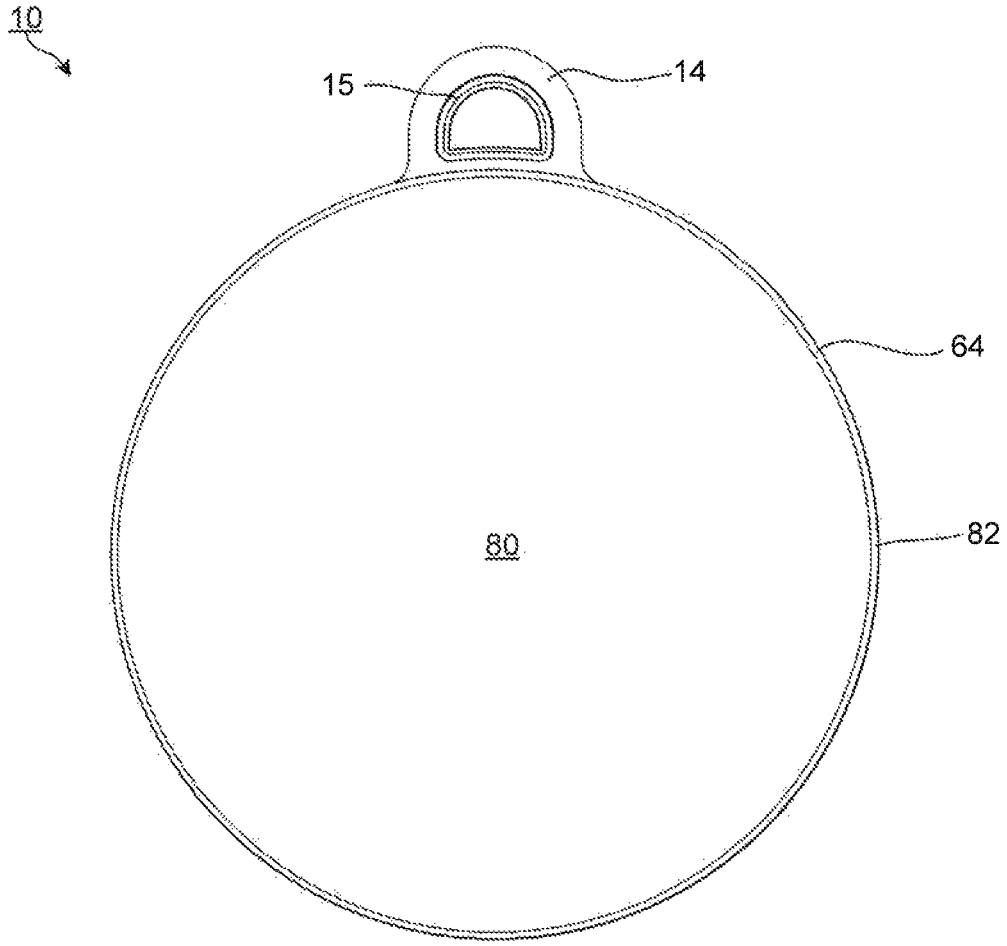
FIG. 8 is a bottom view of the flexible pail.

FIGS. 3 and 8 show that the base 80 is attached to the lower end 64 of the container body 60. Like, the attachment of the cover 20 to the upper end 62 of the container body 60, the same method of attachment is possible for the semi-rigid base 80 and the lower end 64 of the container body 60. That is, the base 80 may have a similar base lip 82. A heat sealing process as discussed above may be applied between the base lip 82 and the second lower end 64. However, it is to be understood that the base 80 may be fastened to the lower end 64 of the container body 60 in a variety of diverse ways, such as but not limited to, an adhesive, a bonding agent, material welding, an/or any other suitable method for attaching the cover 20 to the upper end of the flexible sheet.

Like the cover 20, the base 80 need not have a base lip 82 that bonds to the second lower end 64. It is contemplated that the second lower end 64 of the container body 60 may be bonded directly onto the base 80. The second lower end 64 of the container body 60 may be formed into a plurality of inward facing tabs so that they may be folded inwards without overlapping and be directly bonded to the base 80. The removal of the base lip 82 would allow for the flexible pail 10 to compress into a smaller unit.

Other additions to the flexible pail 10 are also disclosed herein. For example, the flexible pail 10 may also have a loop or tab 14 disposed thereon to hang. As shown in FIGS. 6-12, the loop or tab 14 may be molded along with the cover 20. However, it is to be understood that the loop 14 may be attached anywhere in the flexible pail 10 to provide a location to hang the flexible pail 10. For example, the loop 14 may be constructed into the container body 60. Ultimately, the loop 14 provides a user with the ability to hang the flexible pail 10 in a convenient location. Similarly, the loop or tab 14 may also be used as a handle when transporting the flexible pail from one location to another location. It is also contemplated that multiple loops or tabs 14 are provided to be used as handles and/or hanging points. Although not shown, a hook may fulfill a similar function for the loops or tabs 14.

When the flexible pail 10 has a tab 14, the tabs 14 may have recesses or grooves 15 to provide additional tactile surfaces for better grip. The usage of the recesses 15 may also double as holding points for wide hooks that may fit therein.

Figure 11:
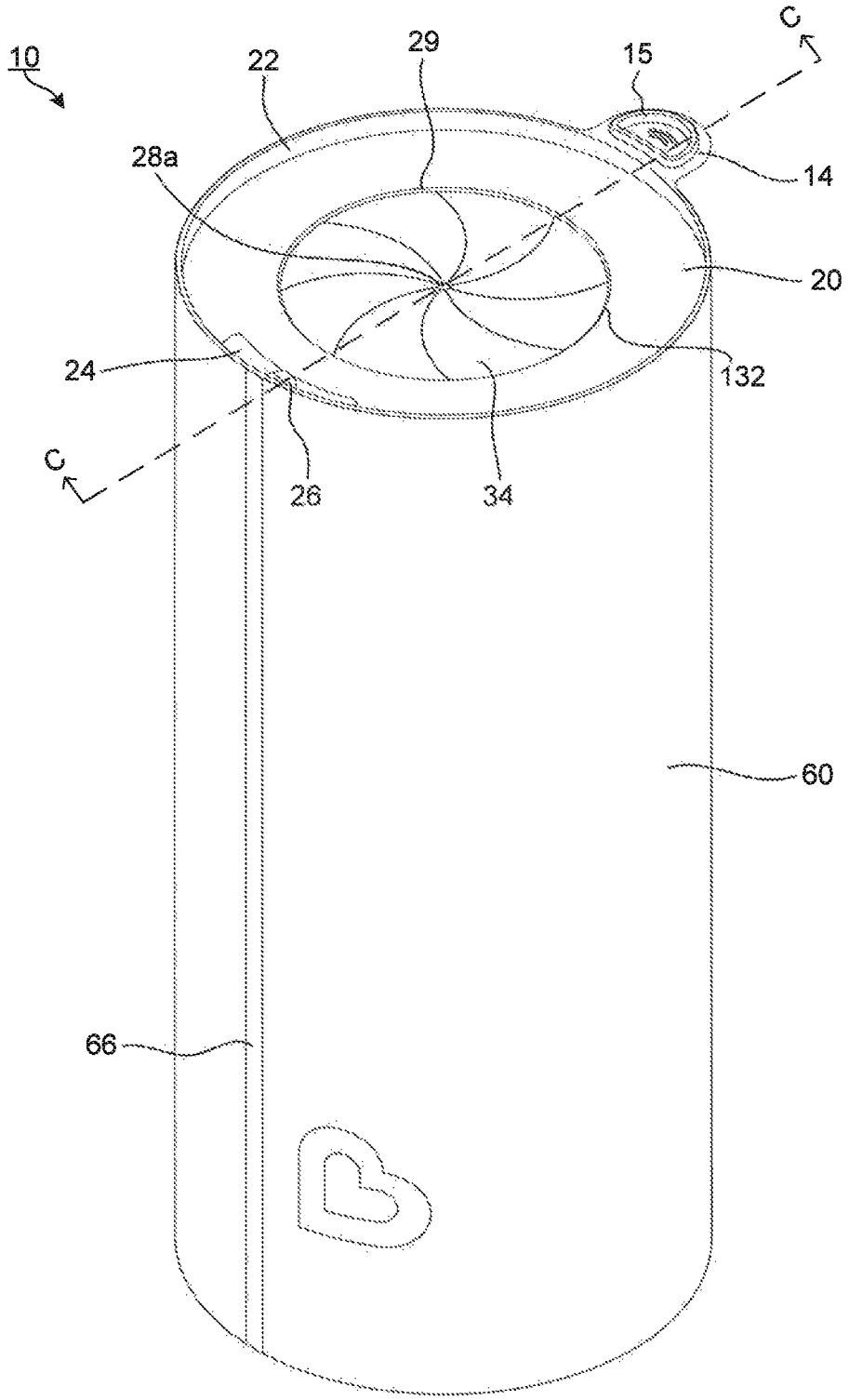
FIG. 11 is an upper perspective view of a second embodiment of the flexible pail without a cover flap shown.
Figure 12:
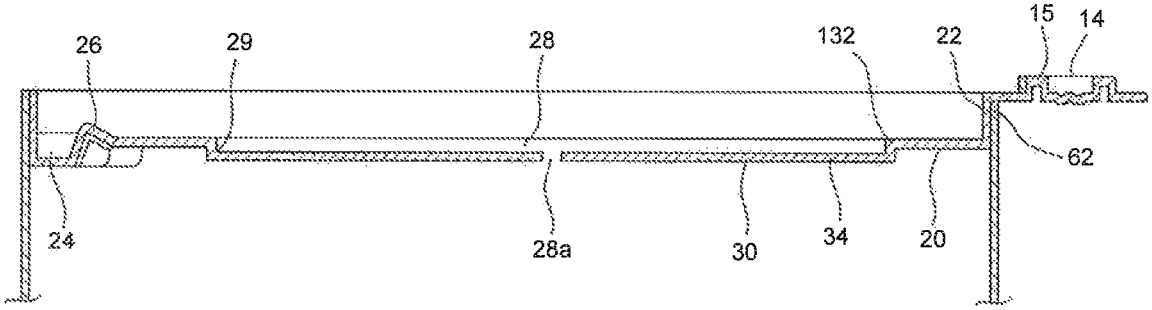
FIG. 12 is a partial cross-section view along C-C of FIG. 11.

FIGS. 11-12 contemplates a barrier shoulder 132 disposed at the edge 29 of the opening 28, where the barrier 30 begins. The barrier shoulder 132 similarly provides additional flexibility of the barrier 30 so that a user may more easily push through the barrier 30 to deposit waste into the compartment 12. The step in the barrier shoulder 132 adds to the strength of the barrier 30 and prevents degradation of the barrier 30 due to the repetitive movement of the barrier fingers 34.

Figure 14:
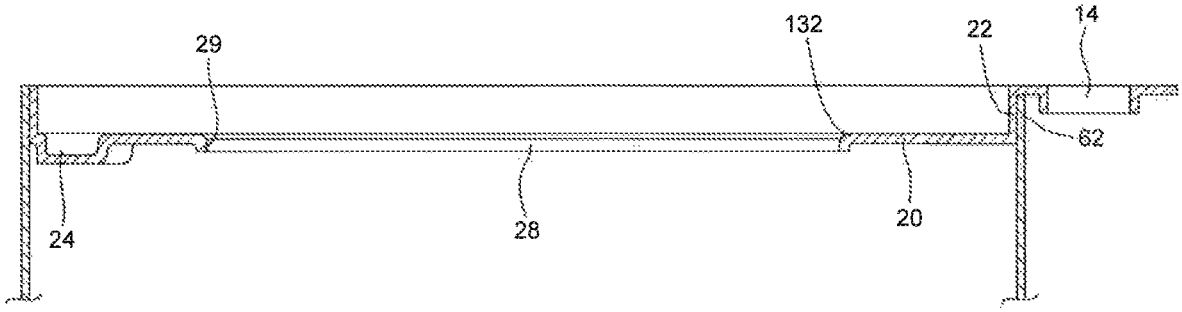
FIG. 14 is a partial cross-section view along D-D of FIG. 13 without a cover flap.

FIGS. 13-14 demonstrate that the flexible pail 10 need not have a barrier 30. By removing that element, the flexible pail 10 would have a larger opening 28, which provides easier access to place waste therethrough.

FIGS. 13-14 further contemplate the flap 40 covering the opening 28 that has base extensions 42*a*. The base extensions 42*a* help prevent the cover flap 40 from peeling off by providing additional surface area for the flap base 40 to bond to the cover 20.

Figure 15:
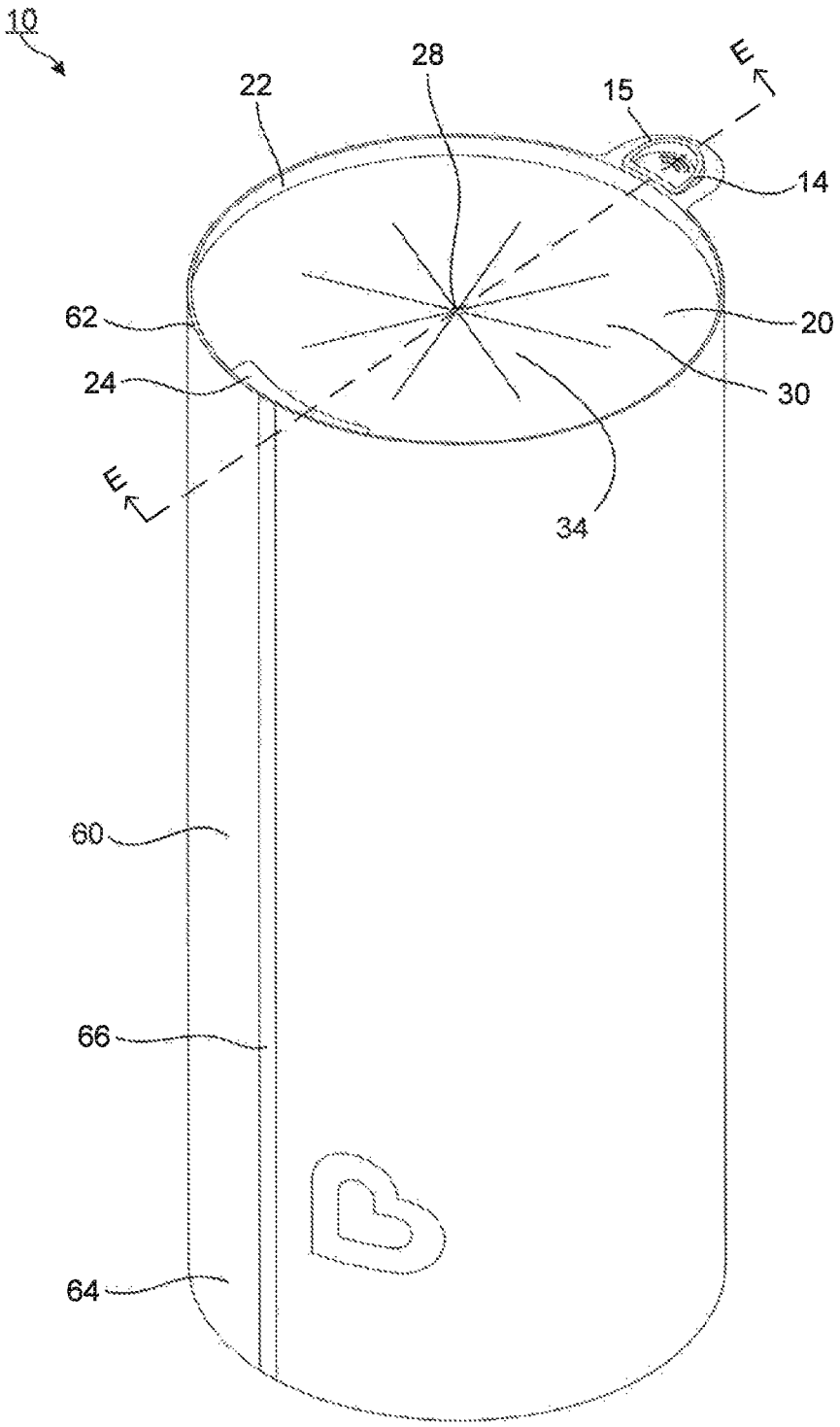
FIG. 15 is an upper perspective view of a fourth embodiment of the flexible pail.
Figure 16:
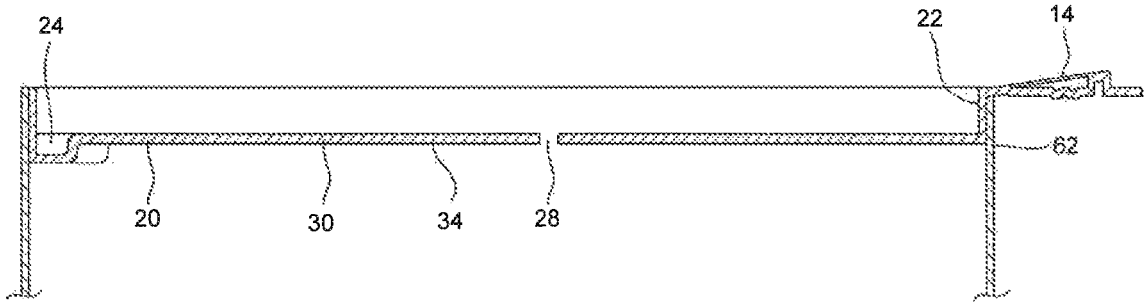
FIG. 16 is a partial cross-section view along E-E of FIG. 15.

FIGS. 15-16 show the flexible pail 10 having the barrier 30 without a recess 32 or shoulder 132. The lack thereof provides more rigidity to the barrier 30 of the flexible pail 10, which would also enhance the flexible pail 10 by lowering the likelihood of the fingers 34 sagging or drooping. Furthermore, the increased rigidity would prevent unwanted or accidental access to the barrier 30 from depressing the fingers 34 and releasing the odor therethrough.

Figure 17:
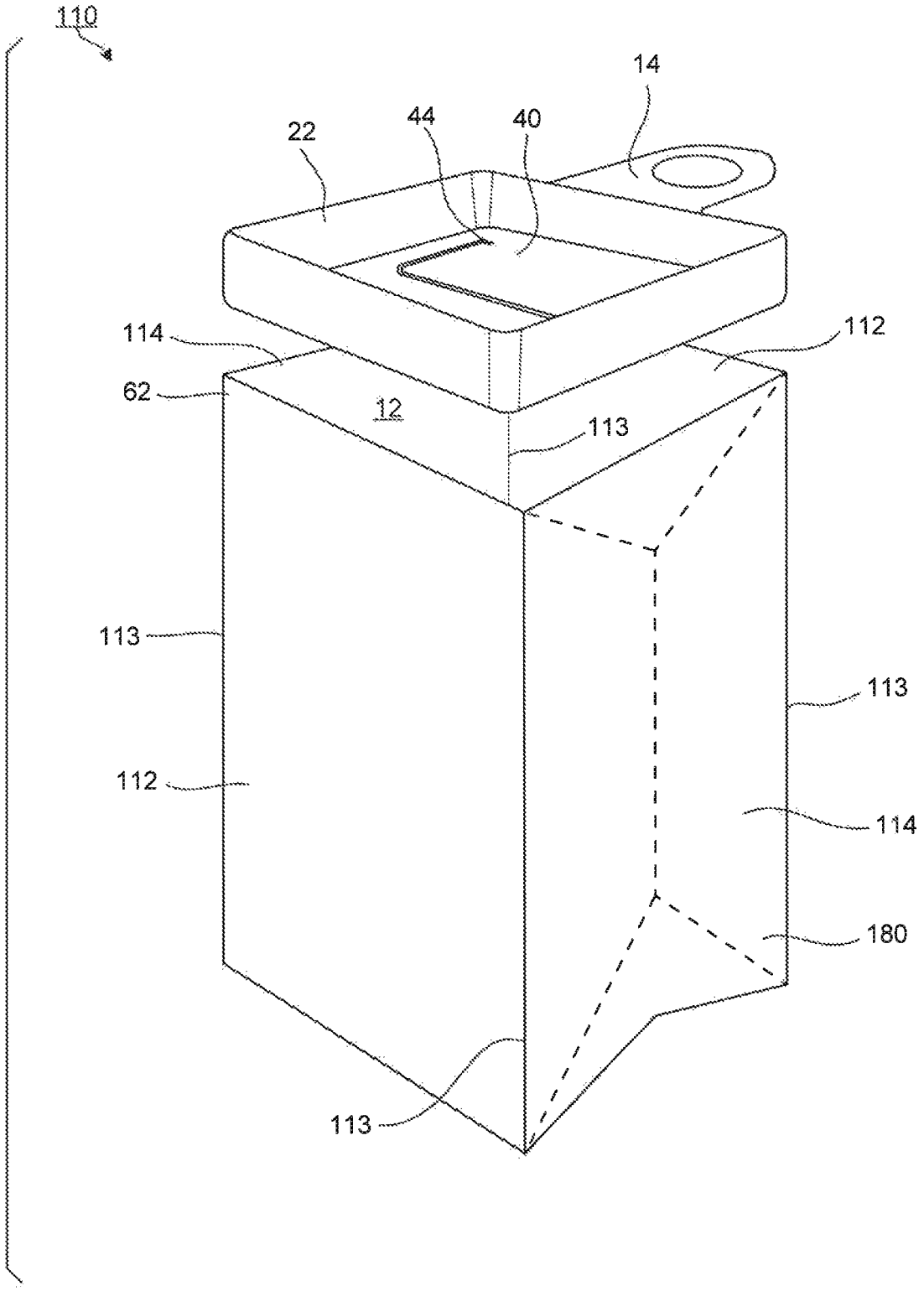
FIG. 17 is an exploded view of a fourth embodiment of the flexible pail.

FIG. 17 shows a rectangular flexible pail 110 according to this subject disclosure. The rectangular shape promotes more volume and a wide base to hold the flexible pail 10 upright. Furthermore, this shape may provide further support to allow the rectangular flexible pail 110 to stand straight upright due to different panels 112, 114 being melded together to create edges 113, which are able to withstand and support the overall shape of the rectangular flexible pail 110. However, it is to be understood that the flexible pails 10, 110 may take any shape or size that accomplishes the task of holding material within. For example, a generally cylindrical shape as disclosed above may also hold material within. Similarly, the generally cylindrical shape would be able to stand upright in addition to holding material within because the downwards weight of the flexible pail would be distributed evenly throughout the side surface of the cylindrical shape.

Figure 18:
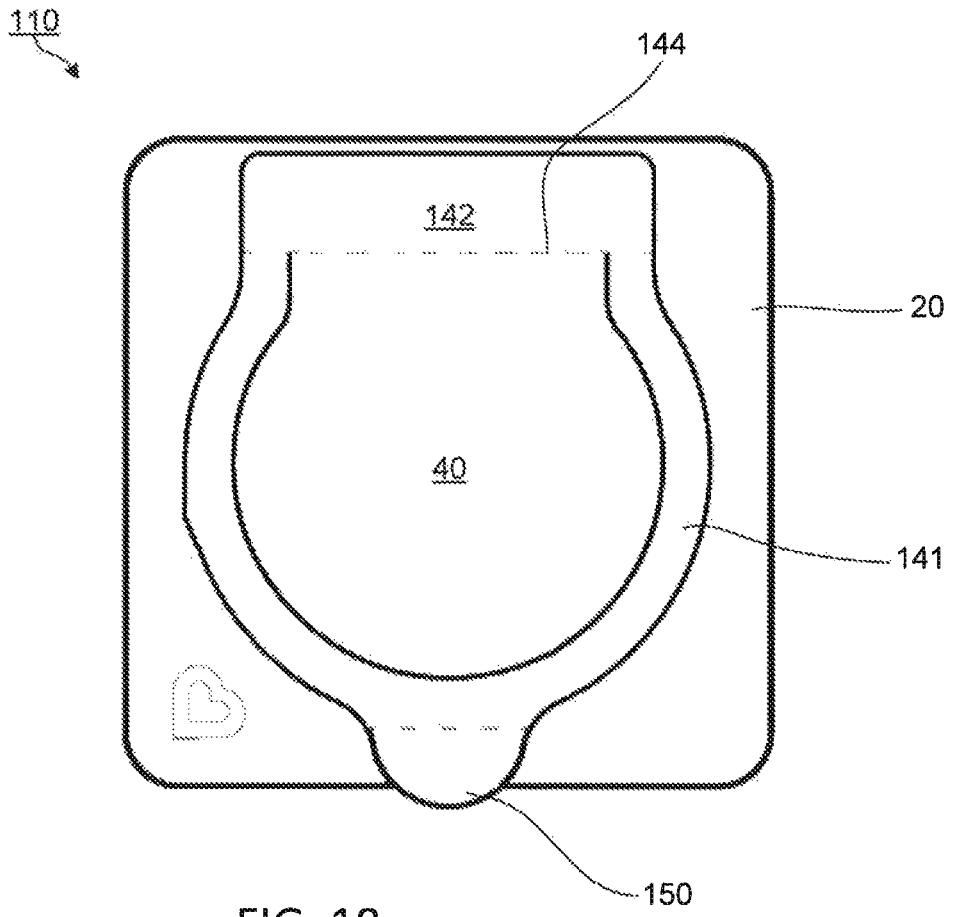
FIG. 18 is a top view of a fifth embodiment of the flexible pail.

FIG. 18 shows the rectangular flexible pail 110 with another embodiment of the flexible cover flap 40 hinged at an extended base 142, which is attached to the cover 20. The flexible cover flap 40 may have the extended base 142, which would prevent the cover flap from peeling off by providing additional surface area for the adhesive to adhere to. There may also be a transparent resealable adhesive sheet 141 that helps provide a method to secure the cover flap. The hinge may also have a geometric diecut 144 to allow the cover flap to stay open. The geometric diecut 144 may also be added to the transparent adhesive 141 to prevent the transparent adhesive sheet 141 from blocking the hinge 44 or vice versa. The flexible cover flap 40 may also have a tab 150 for a user to easily open and close the cover flap.

Figure 19:
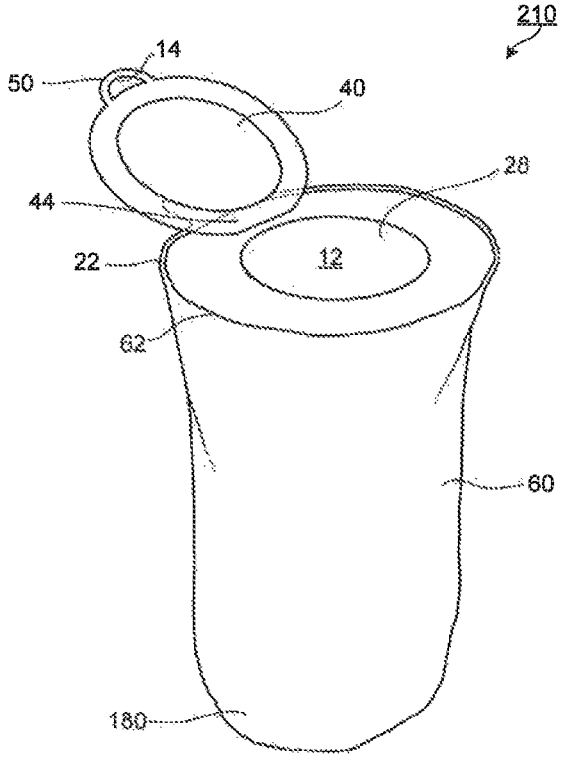
FIG. 19 is an upper perspective view of a sixth embodiment of the flexible pail in an open position.
Figure 20:
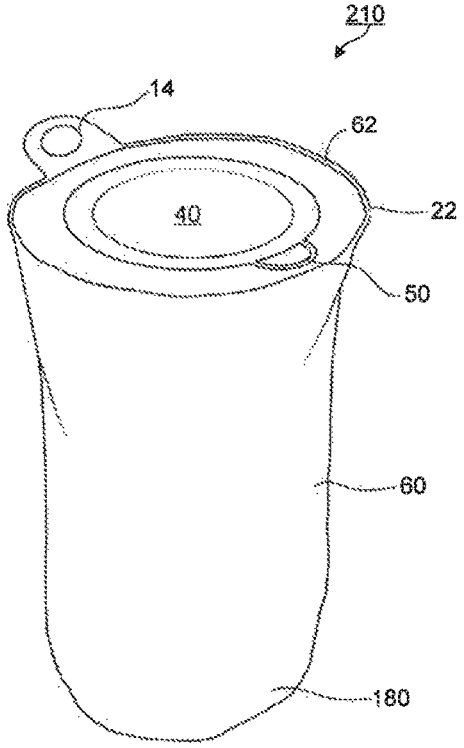
FIG. 20 is an upper perspective view of FIG. 19 in a closed position.

FIGS. 19-20 demonstrate a flexible pail 210 having the cover 20 and the container body 60. The cover 20 has a flap 40 attached thereto. The flexible pail 210 does not have a separate base such as the flexible pail 10 constructed in FIG. 3, which allows the flexible pail 210 to be lighter. Although there is no separately constructed base, the flexible pail 210 may be able to stand due to the rigid properties of the material used for the container body 60. Similar to the above disclosed flexible pail 10, the flexible pail 210 may have a loop 14, which provides the flexible pail 210 the ability to hang onto a hook or other similar structure. Since the base is integral with the container body 60, the flexible pail 210 may rely more often on the loop 14 to hang instead of stand. The flexible pail 210 may be capable of both hanging and standing.

Figure 21:
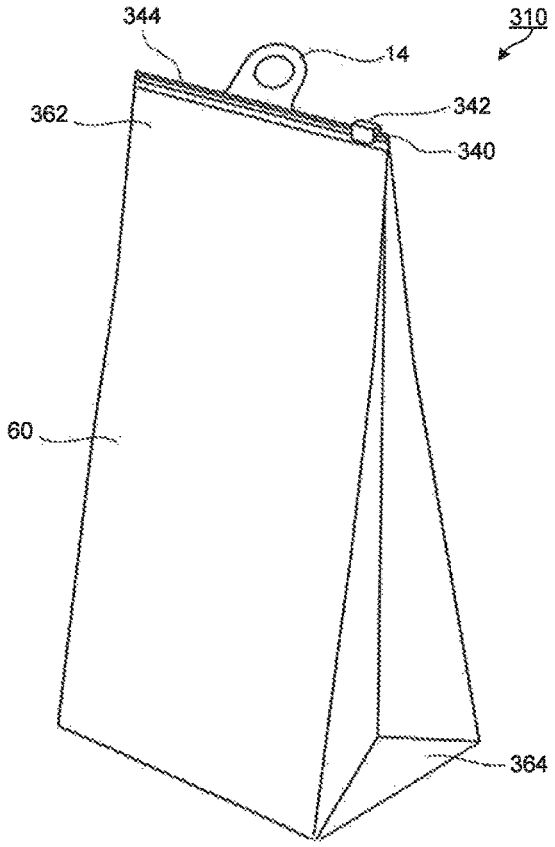
FIG. 21 is an upper perspective view of a seventh embodiment of the flexible pail in a closed position.
Figure 22:
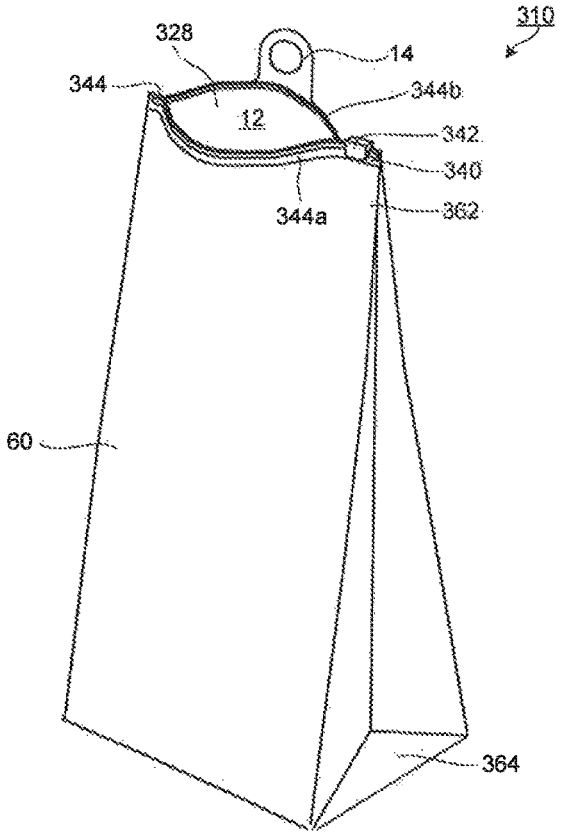
FIG. 22 is an upper perspective view of FIG. 21 in an open position.

FIGS. 21-22 illustrate a flexible pail 310 having a single integrated shape with an upper opening 362 and a closed lower end 364. The upper opening 362 may be sealable in a variety of different ways, such as a seal 340. The seal 340 may be incorporated as a two-part strip 344 along an opening 328 that can be pressed together to lock and seal the opening closed. The two-part strip includes two strips 344*a*, 344*b* and a sealing divider 342 that forms a tight seal when pressed together. Likewise, the sealing divider 342 interlocks grooves and ridges disposed along the top portion of the two strips 344*a*, 344*b* and can also separate the two strips 344*a*, 344*b* with sufficient force to detach the two-parts from each other.

In use, the flexible pail 310 is opened, and a waste item is placed through the opening 328 to be disposed into the compartment 12. Thereafter, the two-part strip 344 is pressed together to cause the interlocking grooves and ridges to be interconnected and form a tight seal. It is to be understood that various other suitable methods may be provided to seal the upper end of the flexible pail according to this disclosure.

FIGS. 23-30 contemplate a flexible pail 410 having cover ribs 21 disposed on the cover 20. The cover ribs 21 provide additional structure and stability to prevent deformation of the cover 20 during delivery, repeated use and other similar situations.

Figure 23:
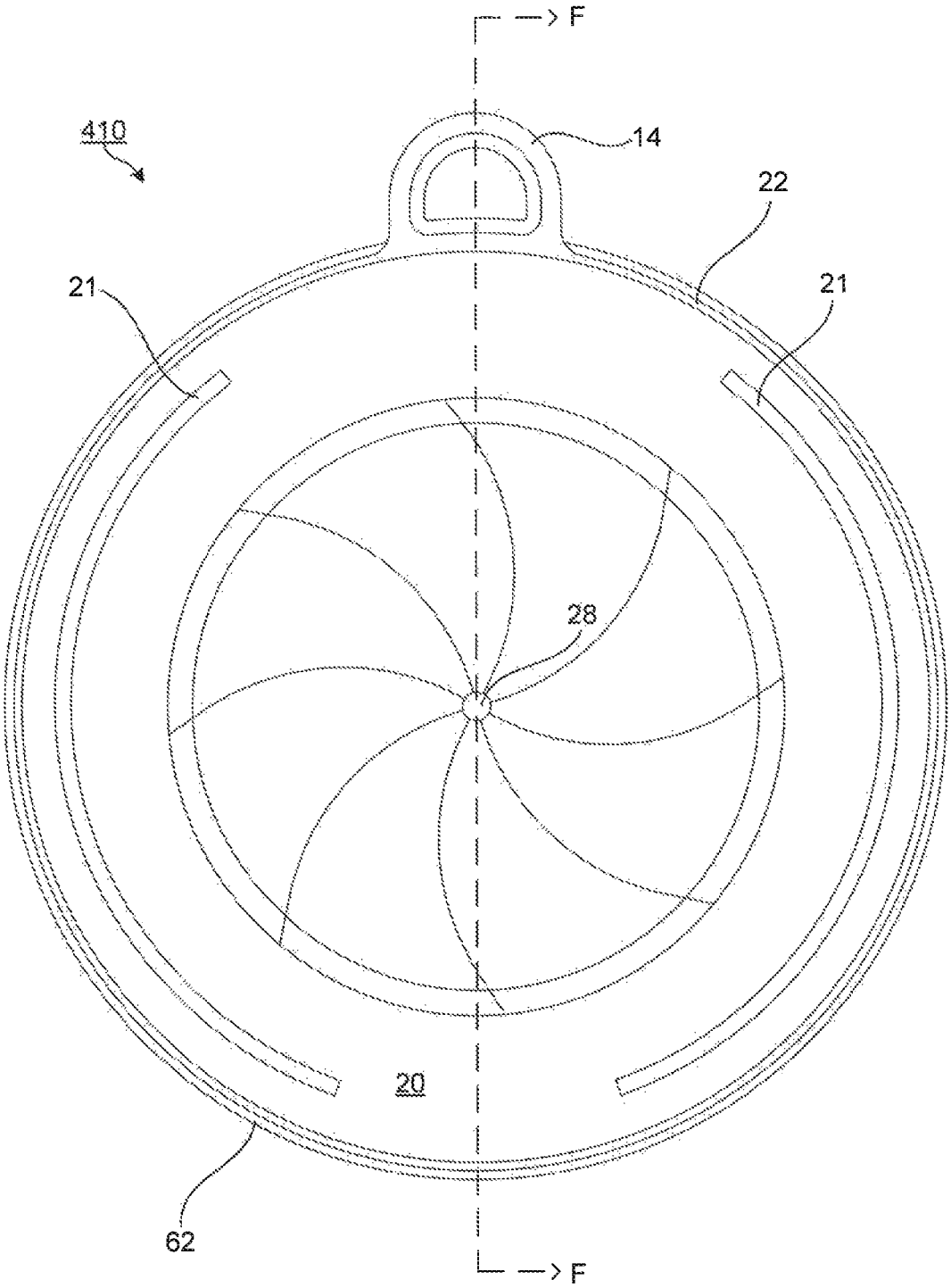
FIG. 23 is a top view of an eighth embodiment of the flexible pail without a cover lip.
Figure 25:
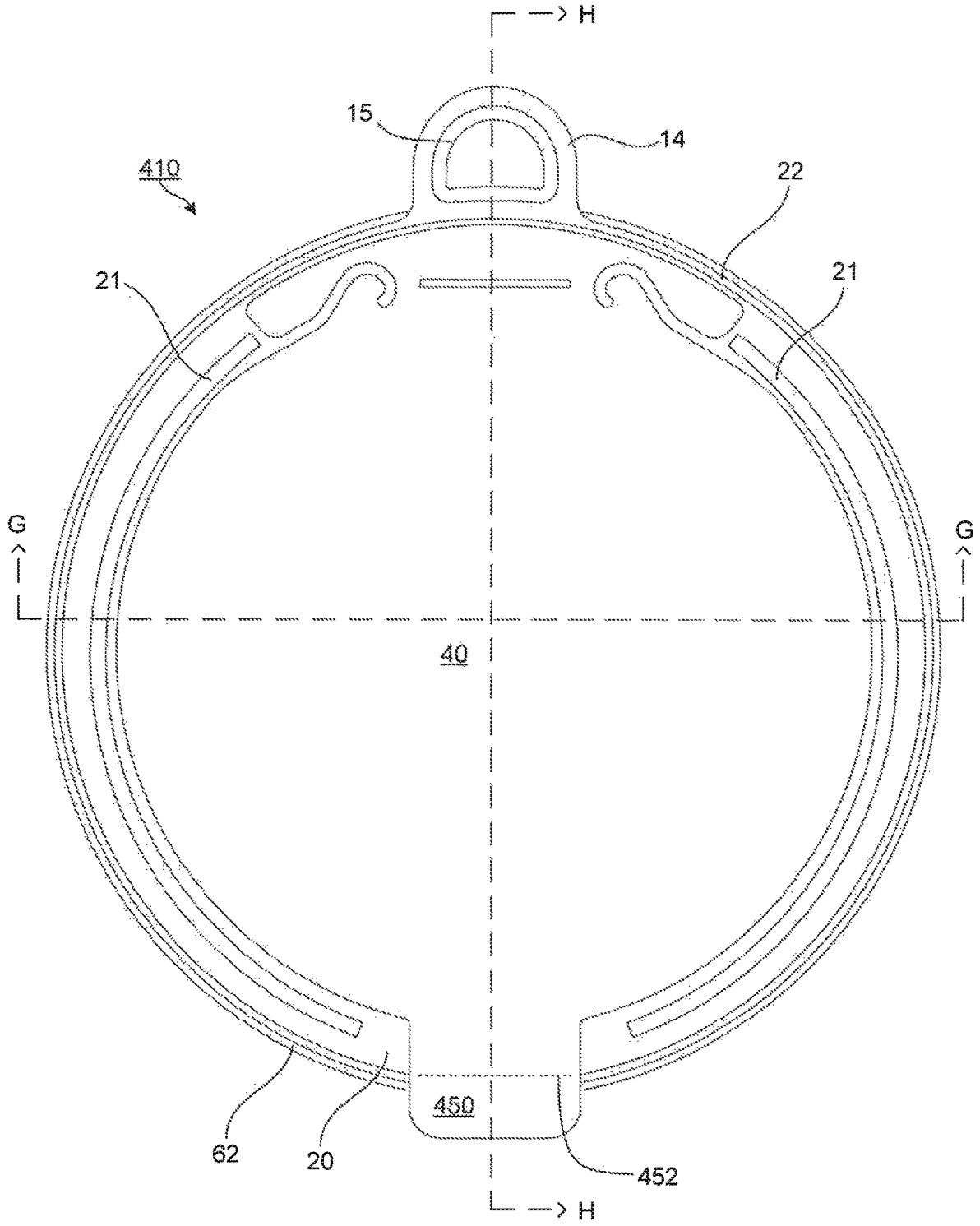
FIG. 25 is a top view of FIG. 23 with a cover lip.

FIGS. 23 and 25 more specifically demonstrate that the cover ribs 21 may be generally semi-circular in shape to fit within the geometry of the cover 20, while also providing space for the lid 40. It is to be understood, however, that the cover ribs 21 may take any geometric shape and/or size to provide stability to the cover 20.

Figure 24:
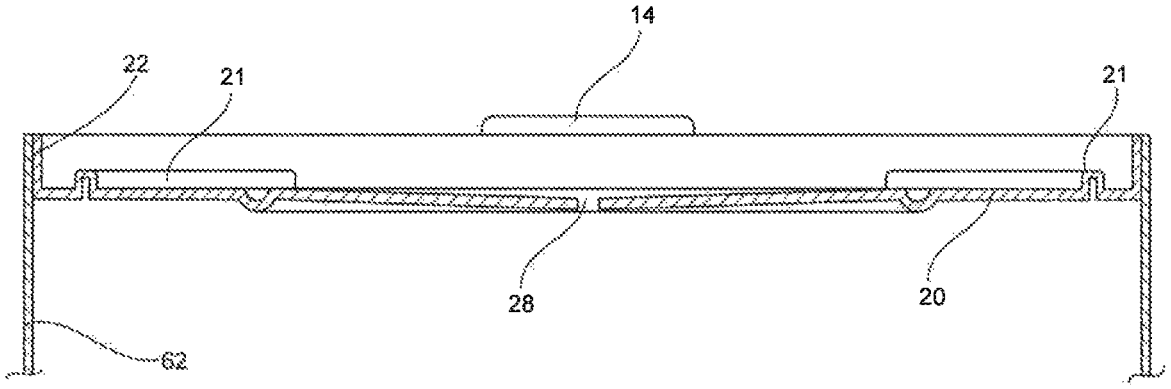
FIG. 24 is a cross-section view along F-F of FIG. 23.
Figure 26:
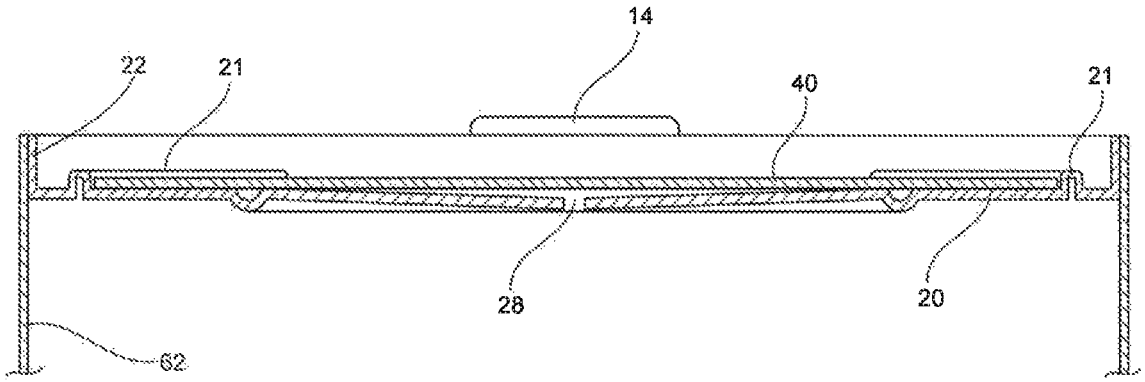
FIG. 26 is a cross-section view along G-G of FIG. 25.

FIGS. 24 and 26 provide further detail of the cover ribs 21. The cover ribs 21 may be protrusions upwards from the cover 20 that are generally hollow. The hollow nature of the cover ribs 21 provide some flexibility to the cover ribs 21 thereby allowing deformation to occur to the cover ribs 21 rather than the cover 20. It is further contemplated that the cover ribs 21 are solid so as to prevent deformation to the cover 20 and the cover ribs 21 entirely. It is to be understood that any combination and variation between hollow and solid may be used for the cover ribs 21. Similarly, the cover ribs 21 may extend downward from the cover 20 to provide the same benefits.

Figure 27:
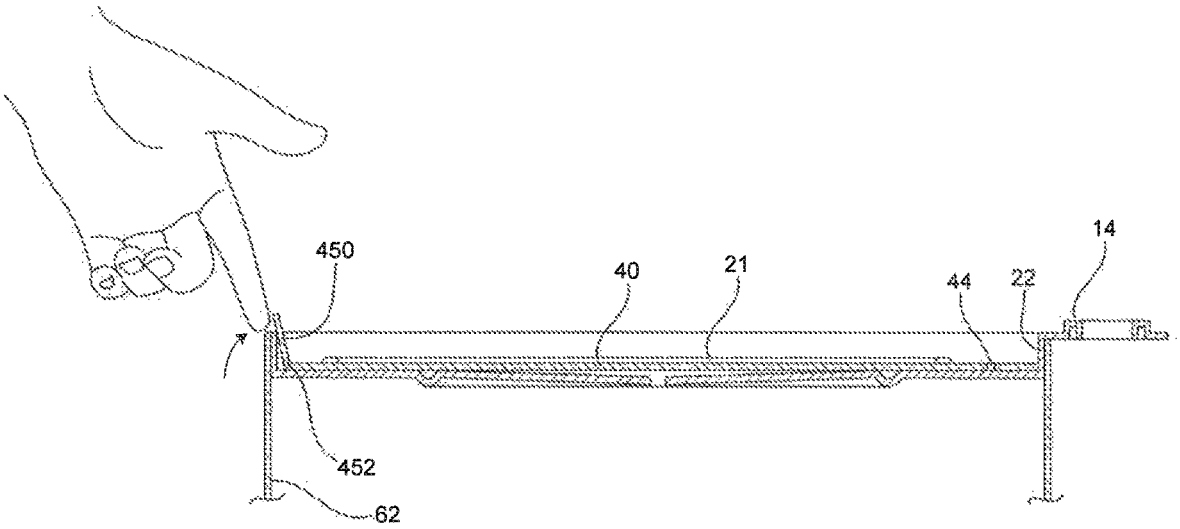
FIG. 27 is a cross-section view along H-H of FIG. 25.
Figure 28:
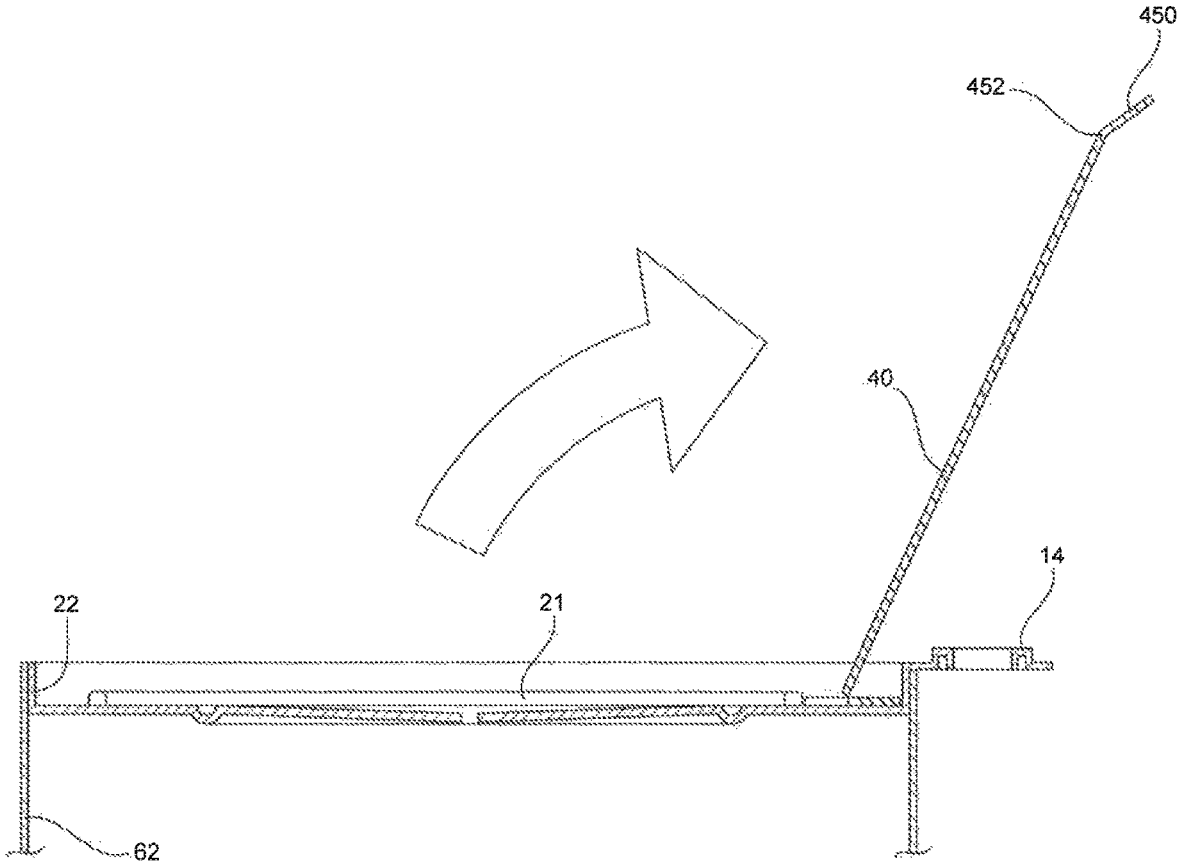
FIG. 28 is the cross-section view of FIG. 27 with the cover lip in an open position.

FIGS. 25, 27 and 28 demonstrate the flexible pail 410 having the flexible cover flap 40 disposed on the cover 20. Furthermore, the flexible cover flap 40 may have a tab 450 to allow a user to easily open and close the flexible cover flap 40. The tab 450 may further have a semi-perforated or flexible edge 452 to allow the tab 450 to more easily bend slightly away from the surface of the cover flap 40. The slight bend created by the flexible edge 452 of the tab 450 then further eases the process by which a user may open and/or close the flexible cover flap 40, while maintaining a high level of adhesion for the cover flap 40 with the cover 20. In other words, the surface area of contact between the cover flap 40 and the cover 20 is not reduced by the tab 450.

Figure 29:
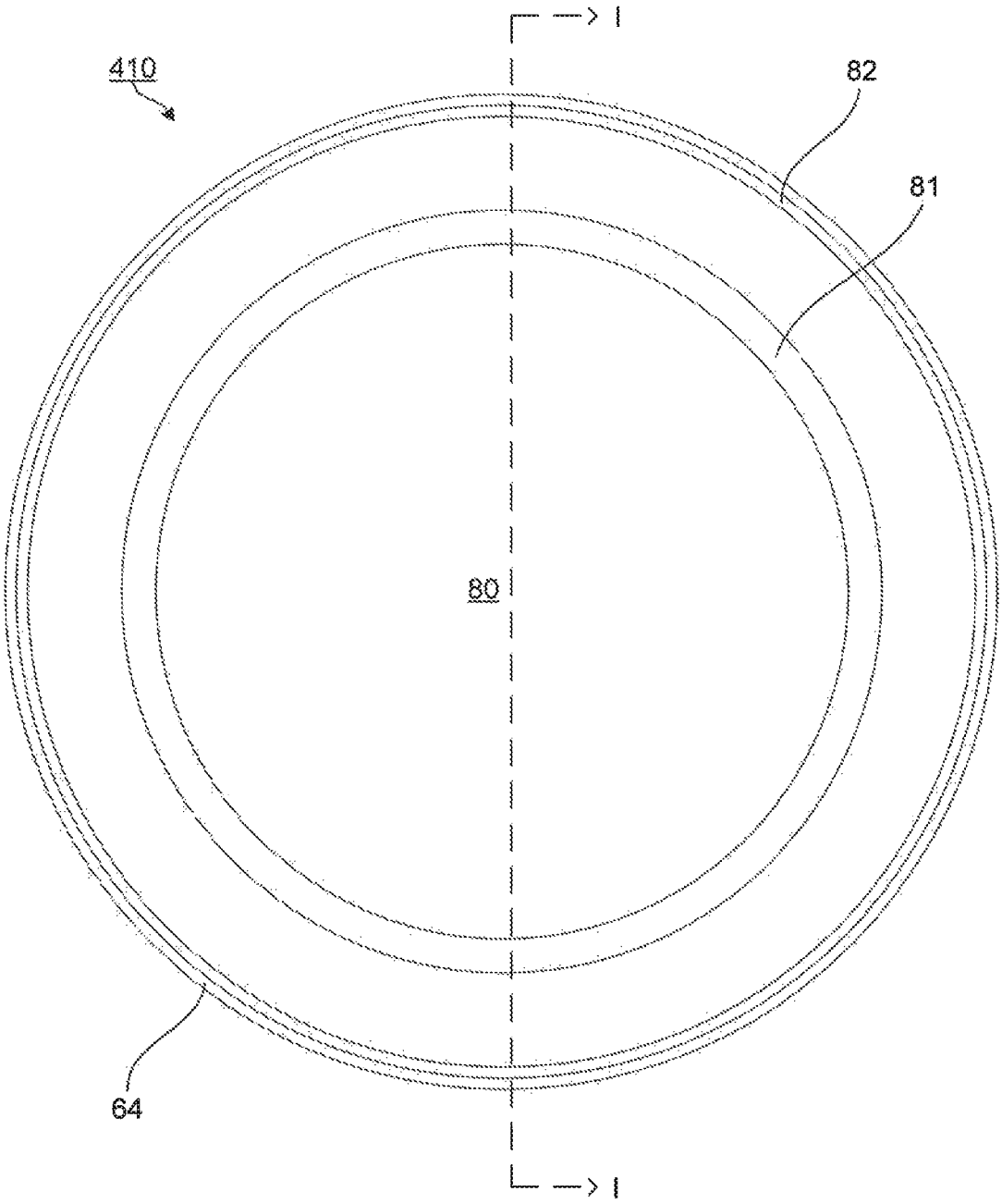
FIG. 29 is a bottom view of FIG. 23.
Figure 30:
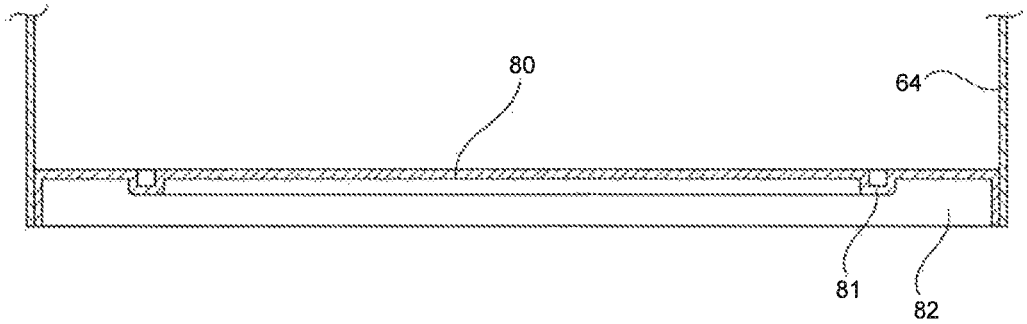
FIG. 30 is a cross-section view along I-I of FIG. 29.

FIGS. 29 and 30 contemplate the flexible pail 410 having base rib 81 on the base 80. The base rib 81 provides additional structure and stability to prevent deformation of the cover 80 during delivery, repeated use and other similar situations.

FIG. 29 more specifically demonstrates that the base rib 81 may be generally circular in shape to fit within the geometry of the base 80. It is to be understood, however, that the base rib 81 may take any geometric shape and/or size to provide stability to the base 80. Furthermore, multiple base ribs 81 may be used in a variety of different combinations to provide stability to the base 80.

FIG. 30 provides further detail of the base rib 81. The base rib 81 may be a protrusion downwards from the base 80 that is generally hollow. The hollow nature of the base rib 81 provides some flexibility to the base rib 81 to allow deformation to occur to the base rib 81 rather than the base 80. It is further contemplated that the base rib 81 is solid so as to prevent deformation to the base 80 and the base rib 81 entirely. It is to be understood that any combination and variation between hollow and solid may be used for the base rib 81. Similarly, the base rib 81 may extend upward from the base 80 to provide the same benefits.

Each flexible pail 10, 110, 210, 310, 410 is capable of being adapted to receive waste from infant, children, adults and/or pets. For example, the openings 28, 328 may be adapted to be larger to accommodate larger waste diapers from adults. Similarly, the openings 28, 328 may be adapted to be smaller to accommodate smaller waste diapers from infant, children and/or pets, while providing increased odor retention.

Figure 31:
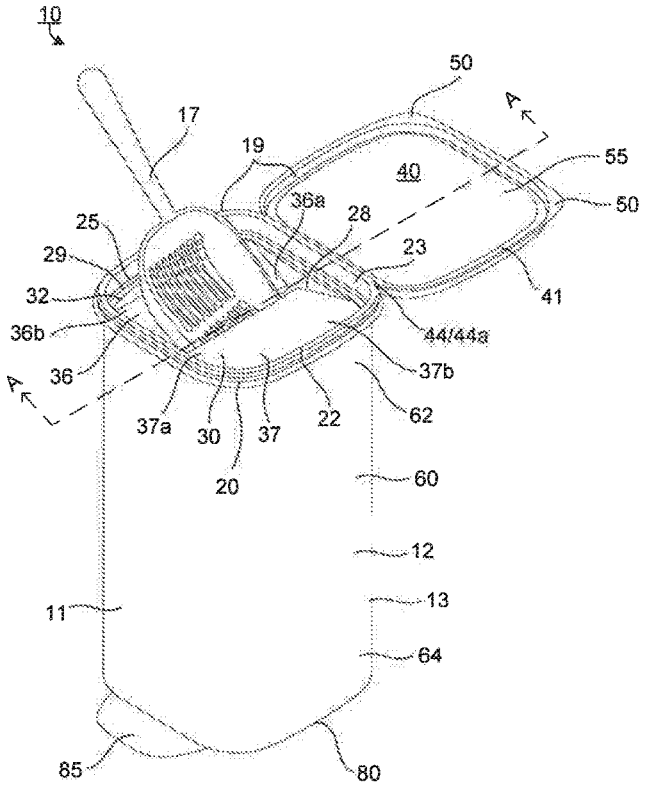
FIG. 31 is a front perspective view of a flexible pail with a lid in an open position.

FIG. 31 is a front perspective view of the flexible pail 10 in an open position having a container body 60 with an interior chamber 12 adapted to receive waste, a base 80 attached to the lower end 64 of the container body 60 and a cover 20 attached to the upper end 62 of the container body 60 with a lid 40 connected by a hinge 44 to the cover 20.

As shown in FIG. 31 (*see* also FIGS. 33, 35), the cover 20 and the lid 40 are connected by a hinge 44. The hinge 44 may be a separate fastener that attaches the lid 40 to the cover 20, or the hinge 44 may be integrally formed with the cover 20 and the lid 40. The hinge 44 shown in FIG. 31 is a living hinge 44*a*. The living hinge 44*a* is a thin, flexible hinge formed of the same material as the two rigid pieces (20, 40) it connects. The living hinge 44*a* allows the rigid pieces (20, 40) to bend along the line of the hinge with minimal friction wear on the structural integrity of the hinge. Plastic living hinges may be manufactured by injection molding or embossing operations that create all three parts at one time as a single piece.

Figure 33:
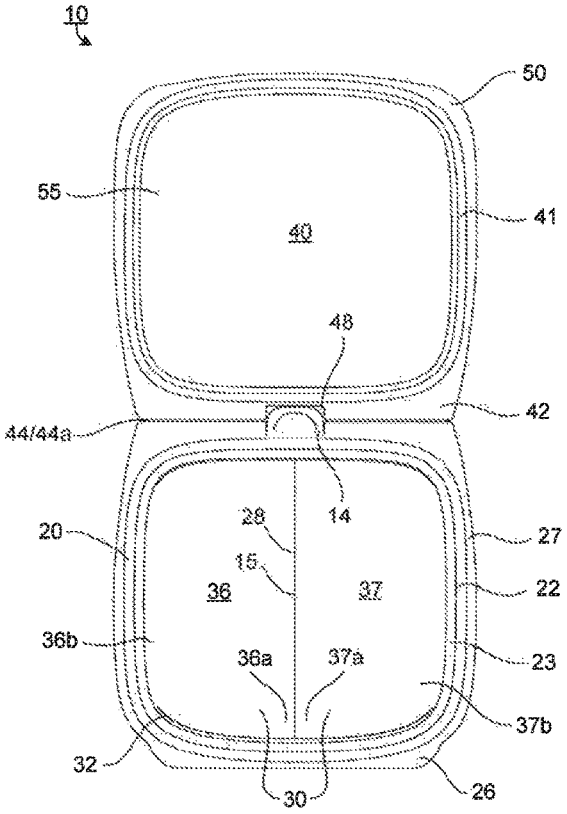
FIG. 33 is a top view of the flexible pail with the lid in the open position.
Figure 35:
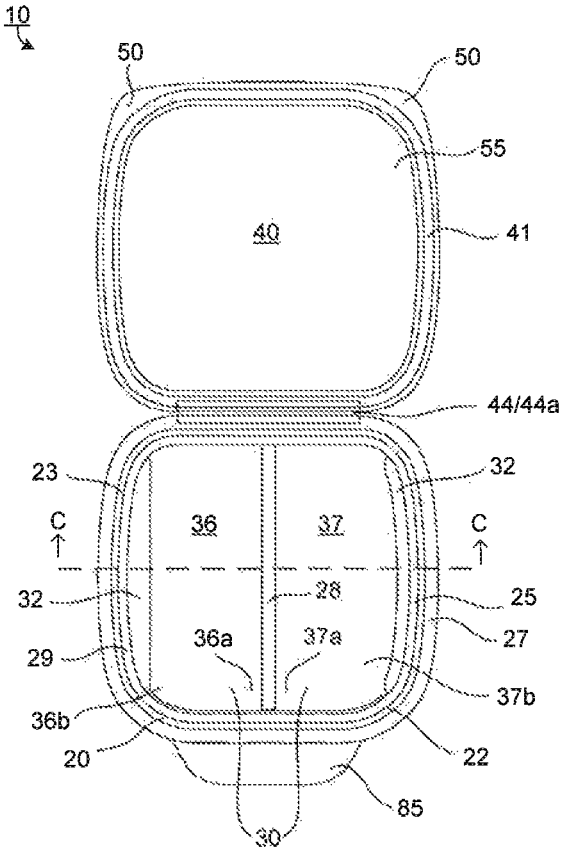
FIG. 35 is a top view of the flexible pail with the lid in the open position.

A shown in FIGS. 31, 33 and 35, the cover 20 may be permanently, or removably, attached to the upper end 62 of the container body 60. It is contemplated that the container body 60 may be replaceable, while the cover 20 and base 80 may be reusable. Alternatively, the cover 20 may be reusable, while the container 60 body and base 80 may be replaceable. When the flexible pail 10 is full, the cover 20 may be removed from the container body 60 and the container body may be sealed or tied off at the upper end 62. Likewise, the lower end 64 of the container body 60 may be tied-off or sealable if the base 80 is reusable. The tied-off container body 60 of the flexible pail 10 may be discarded, while the cover 20 may be reused with a fresh container body 60. This configuration may be desirable if the cover 20 includes features adapted (not shown) for the use with an odor-remediating insert or a UV-C sterilizer insert (not shown). An odor remediating insert helps to control malodor, while a UV-C sterilizer insert kills potentially harmful microbes.

The flexible pail 10 may be adapted to fit within an external frame (not shown). The external frame may be collapsible. The flexible pail 10 may attach at a top or bottom of the external frame in order to provide an even higher degree of strength and stability to the flexible pail 10.

As shown in FIGS. 31, 33 and 35, the cover 20 may have an opening 28 that provides access to the interior chamber 12. The cover may have a barrier 30 that restricts the opening 28 and limits access to the interior chamber 12 (see also FIG. 37). As mentioned previously, the cover 20, lid 40 or container body 60 may be disposed with a socket or attachments for use with an odor-remediating insert or a UV-C sterilizer insert in order to ameliorate malodor or sanitize the flexible pail 10, respectively (not shown). The odor-remediating insert or UV-C sterilizer insert may be reusable and adapted to remain effective over the lifetime of multiple flexible pails 10.

Figure 37:
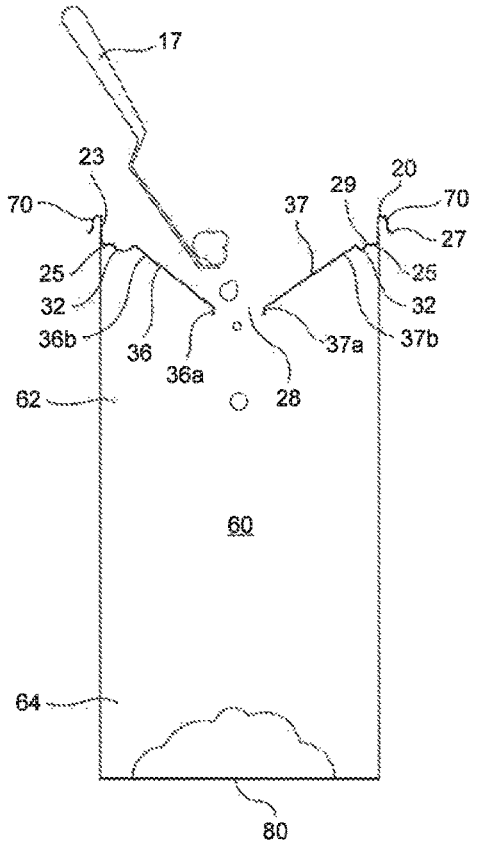
FIG. 37 is a side view of the flexible pail without the lid.

As shown in FIGS. 31 and 37, the barrier 30 may be formed with a first or left door 36 and a second or right door 37 from the perspective of one facing a front side 11 of the flexible pail 10. Defining a point of contact between the left door 36 and the right door 37 as a center 15 of the cover 20 (see FIG. 33), the left door 36 has a proximate end 36*a* disposed towards the center 15 and a distal end 36*b* disposed towards an outer perimeter 27 of the cover 20. The right door 37 has a proximate end 37*a* disposed towards the center 15 of the cover 20 and a distal end 37*b* disposed towards the outer perimeter 27 of the cover.

The left and right doors 36, 37 are adapted to receive a dustpan/scoop 17, or the like, into the opening 28 for the depositing of waste, while preventing the release of malodor from the interior chamber 12 when the barrier 30 is biased closed. Inserting waste into the opening through the barrier doors 36, 37, as opposed to the barrier fingers 34 (as shown in FIG. 2), is a different tactile experience for the user. The barrier doors 36, 37 require less force to push open and result in less contact between the barrier 30 and the user's hand, scoop or the like.

FIGS. 31, 33, and 35 show the cover 20 having a left door 36 and a right door 37, but it is also contemplated that the barrier 30 could be configured as a front and rear door from the perspective facing the front side 11 of the flexible pail 10. Alternatively, the barrier 30 could be comprised as a single door or multiple doors. Four doors, for example, would each occupy one quarter of the opening 28 and meet in the center 15 of the cover 20 thereby allowing easy access to the interior chamber 12 for both hands and scoops 17 alike. The barrier 20 may be comprised of multiple levels. That is, barrier doors 36, 37, or a plurality of barrier fingers 34, may be arranged in an upper level and a lower level (not shown). Multiple barrier levels may be disposed in the cover 20 to prevent the release of malodor. Multiple barrier levels may incorporate a combination of both barrier doors, 36, 37 and barrier fingers 34. The cover 20 may also be disposed in the flexible pail 10 without the lid 40.

Figure 32:
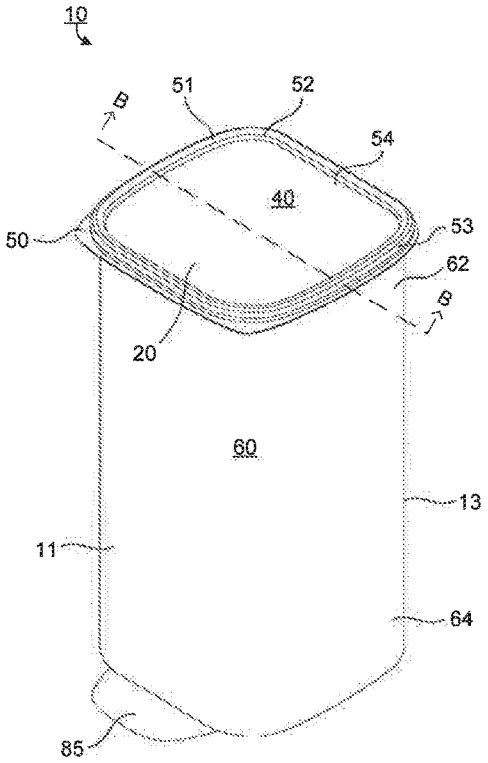
FIG. 32 is a front perspective view of the flexible pail with the lid in a closed position.

As shown in FIGS. 31-32, the flexible pail 10 may have a foot pad 85 to stand on disposed at the lower end 64 of the container body 60, or the base 80 of the flexible pail 10. FIGS. 31-32 show the foot pad 85 attached to the base 80. The foot pad 85 is adapted for a user to stand on, or brace against, when opening the lid 40 from the cover 20. At least one tab 50 may be disposed on the lid 40 for a user to grasp and pull when opening the lid 40 away from the cover 20. A user may grasp the tab 50 with one hand and brace the flexible pail 10 to generate enough force to open the lid 40 from the cover 20 by pushing her foot against the foot pad 85. In other words, the foot pad 85 allows for easy, one-handed opening of the flexible pail 10.

FIG. 32 shows the external structure of the lid 40. The lid 40 may have the at least one tab 50 disposed along a lid perimeter surface 56 that extends along the outer edge of the lid 40. A raised portion 51 is disposed on an outer face 53 of the lid 40 that corresponds to the upward extension of the lid recess 41 that is disposed on an inner surface 55 of the lid 40. The lid recess 41 (FIG. 31) is adapted to interact with a cover lip 22, together forming a sealing mechanism 19, disposed on the cover 20 in order to securely seal the flexible pail 10 and prevent contents or malodor from escaping the flexible pail 10 (see also the cross-section of FIG. 40). The raised portion 51 of the lid 40 has an outer face 53 and an inner face 52. The lid 40 may be disposed with an additional opening or aperture (not shown) that is in communication with the opening 28 of the cover 20, and therefore the interior chamber 12 of the flexible pail 10. Smaller waste items may be inserted through the opening in the lid 40 without having to remove the lid 40 from the cover 20. The opening in the lid 40 may be covered by a secondary lid or other opening closure to keep malodor from escaping.

The lid 40 may include a pop tab (not shown). The pop tab is a raised tab with at least one joint on the lid that is pushed by a user in order to generate leverage to open the lid 40 from the cover 20. With a minimal amount of force, the pop tab releases the lid 40 from the cover 20. The pop tab is reset when the user closes the lid 40.

Figure 34:
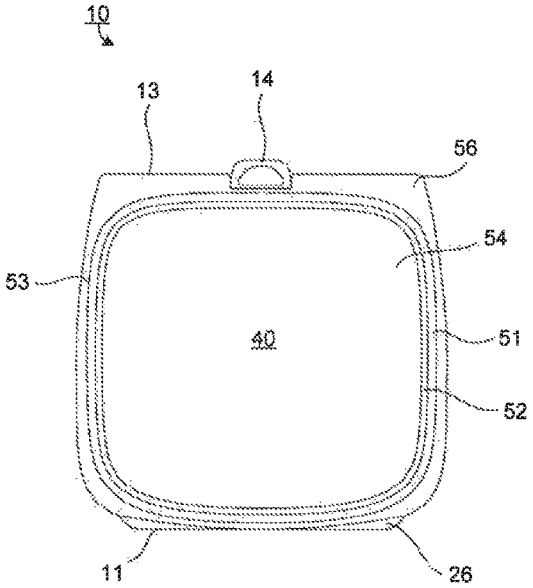
FIG. 34 is a top view of the flexible pail with the lid in the closed position.

FIG. 33 illustrates a top view of the flexible pail 10 in an open position with the lid 40 open from the cover 20. FIG. 34 shows a top view of the flexible pail 10 in a closed position with the lid 40 securely fastened to the cover 20. As shown in FIG. 33-34, the cover 20 may have a tab or hook 14 disposed at a rear side 13 of the flexible pail 10. The cover 20 has an aperture 48 that is formed in the living hinge 44*a* where the lid 40 meets the cover 20. The hook 14 is disposed in the aperture 48. The aperture 48 provides access to the hook 14 with the lid 40 in both the open position shown in FIG. 33, and in the closed position shown in FIG. 34. The flexible pail 10 may be suspended or secured by the hook 14 before opening and closing the lid 40, or the lid 40 may be opened and then secured to an appropriate anchor by way of the hook 14. It is also contemplated that the hook 14 may be disposed at the front side 11 of the flexible pail 10, or at another location along the outer perimeter 27 of the cover 20.

Figure 41:
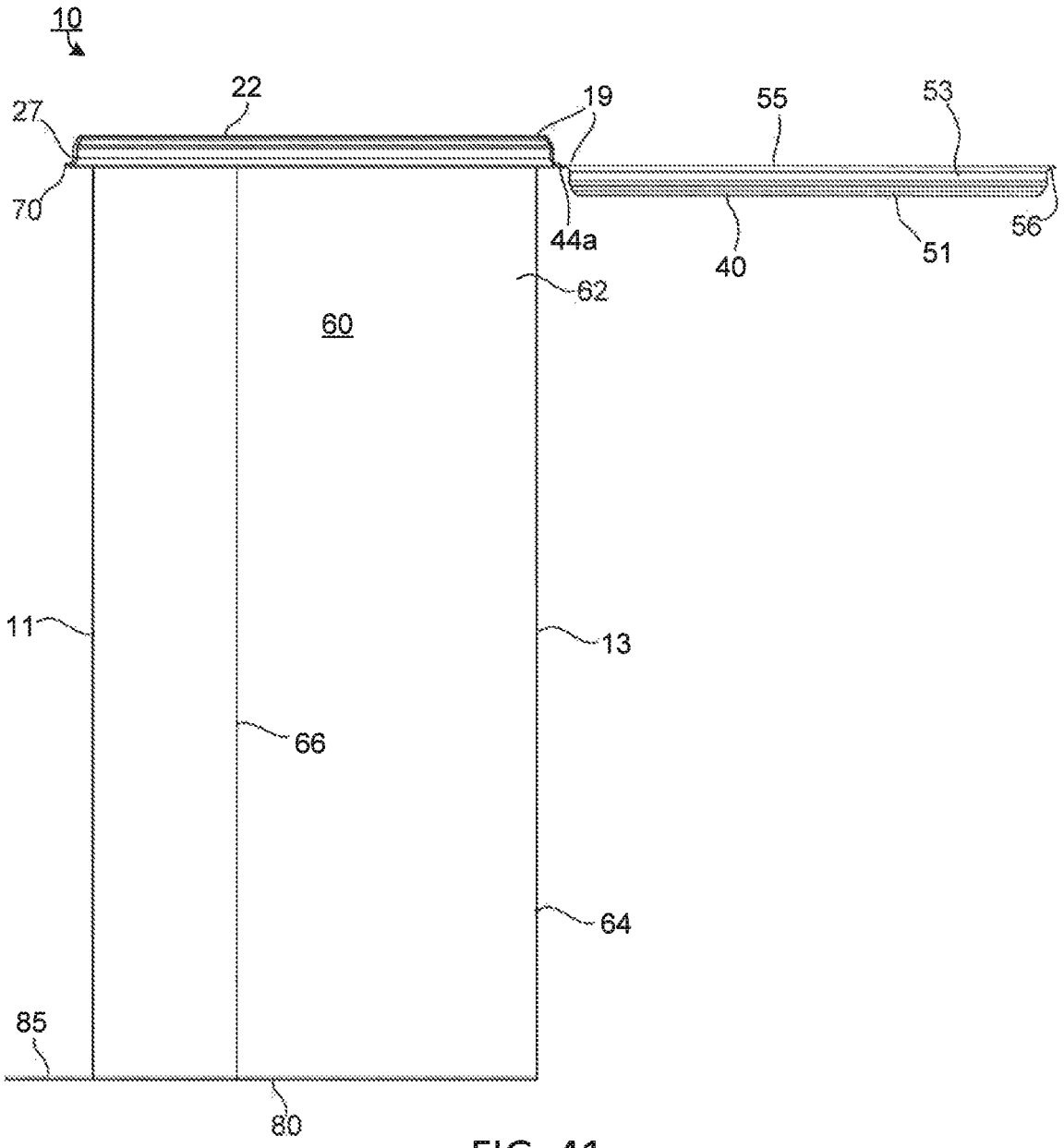
FIG. 41 is a side view of the flexible pail with the lid in the open position.
Figure 47:
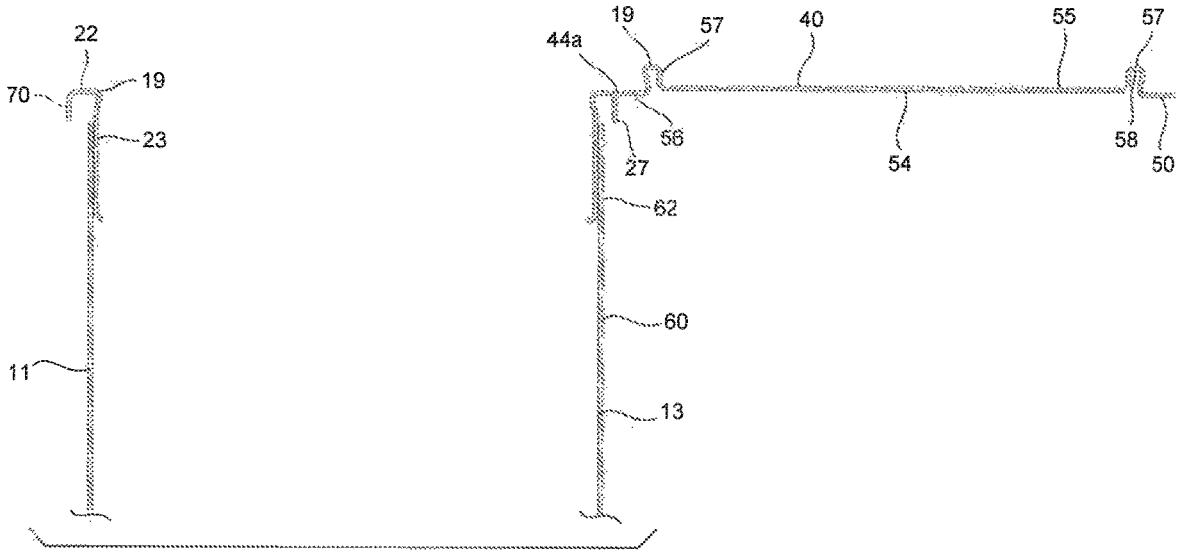
FIG. 47 is a cross-section of the flexible pail with the lid in the open position about the line D-D as shown in FIG. 43.

As shown in FIGS. 31, 41 and 47, the lid 40 and the cover 20 are secured together by a sealing mechanism 19 formed by mating features on the lid 40 and the cover 20. The cover lip 22 of the cover 20 is a raised ridge surrounding the opening 28 in the cover 20. The lid recess 41 (FIGS. 31, 33, 35) is disposed on the inner surface 55 of the lid 40. When the lid 40 is closed against the cover 20, the cover lip 22 and the lid recess 41 matingly form a seal secured by a friction fit.

It is contemplated that the cover lip 22 and the lid recess 41 may have complementary geometry that may provide a keyed fit between the lid 40 and the cover 20. For example, a projection (not shown) disposed on the side of the cover lip 22 may fit within a channel disposed in the lid recess 41 (or a projection in the lid recess 41 may fit within a channel disposed on the side of the cover lip 22), in order to securely seal the contents of the flexible pail 10 from the external environment. Other sealing mechanisms between the cover 20 and the lid 40 may include hook-and-loop, snap-fit, magnetic points of attachment, and the like according to this subject disclosure.

Figure 36:
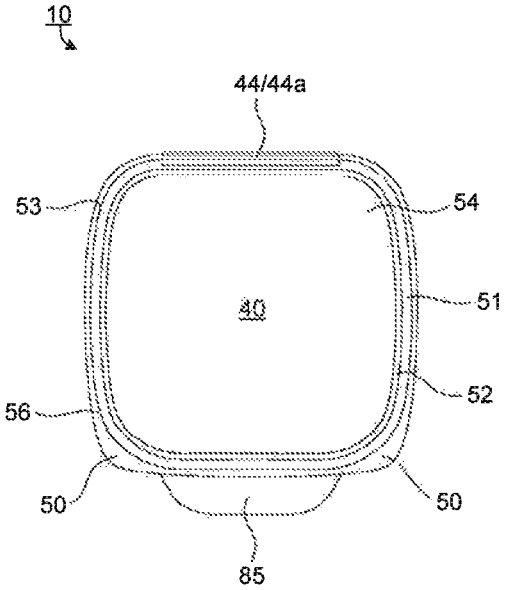
FIG. 36 is a top view of the flexible pail with the lid in the closed position.

FIGS. 35-36 show the flexible pail 10 with the lid 40 in the open and the closed positions, respectively. As shown in FIG. 35, the living hinge 44*a* may be reinforced to provide additional strength and resiliency to withstand repeated use. The barrier 30 may also include at least one barrier recess 32 to strengthen the left and/or right door 36, 37. The barrier recesses help to bias the barrier doors 36, 37 towards a closed position before and after use. Additionally, the barrier 30 may include at least one cover rib 21 (as shown in FIG. 24) to add strength and resiliency to the barrier doors 36, 37.

As shown in FIG. 35 and FIGS. 37-40, the barrier recess 32 is disposed at the distal end 36*b*, 37*b* of the left and right doors 36, 37. An edge 29 delineates the outer boundary of the barrier recess 32 and an interior perimeter 25 that may surround the entire opening 28 of the cover 20. The interior perimeter 25 is bordered by an interior wall 23 that makes up the internal face of the cover lip 22. The structure of the cover 20 and the complementary features on the lid 40 provide strength and rigidity to the flexible pail 10 in both the open and closed position and enables the flexible pail 10 to withstand heavy use.

Figure 38:
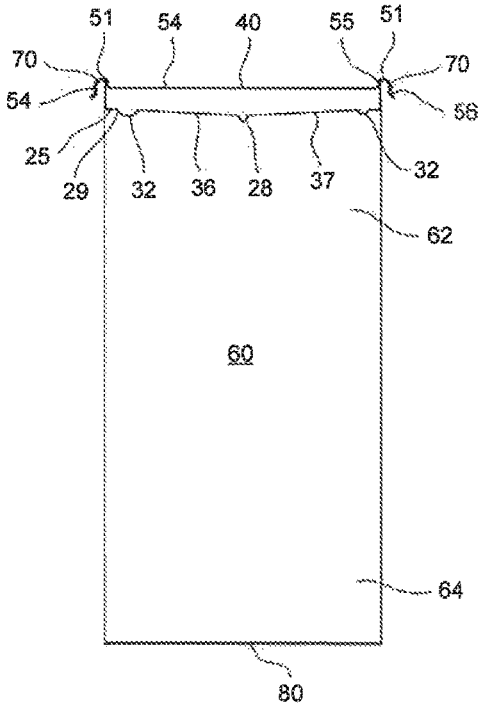
FIG. 38 is a side view of the flexible pail with the lid in the closed position.

FIG. 37 illustrates a side view of the flexible pail 10 with the lid 40 completely removed from the cover 20. FIG. 38 illustrates a side view of the flexible pail 10 with the lid 40 attached to the cover 20 in a closed position. As shown in FIG. 37, waste contained in the scoop 17 is pushed through the barrier 30 formed by the left door 36 and the right door 37. The barrier doors 36, 37 give way to the downward pressure of the scoop 17, enlarging the opening 28 to accommodate the scoop 17 and the waste contained therein. When the scoop 17 is removed from the opening 28, the barrier doors 36, 37 return to the closed position. The barrier recesses 32 disposed at the distal ends 36*b*, 37*b* of the barrier doors act as a spring that biases the barrier doors 36, 37 back to the closed resting position shown in FIG. 38.

As shown in FIG. 37, the flexible pail 10 may include at least one handle 70 disposed on the lid 40 or cover 20. The handle 70 enables a user to easily move the flexible pail 10 or brace the flexible pail 10 with one hand, while opening the lid 40 with the other hand. The handle 70 may be continuous with the cover lip 22 and extending further outward, or the handle 70 may be disposed separately on the cover 20 or the container body 60 as additional structure apart from the cover lip 22.

As shown in FIG. 37, the width of the opening 28 of the cover 20 increases when the barrier doors 36, 37 are opened. The width of the opening 28 may be measured by the distance between the proximate end 36*a* of the left door 36 and the proximate end 37*a* of the right door 37. The proximate ends 36*a*, 37*a* of the barrier doors 36, 37 may be configured to overlap slightly when the barrier 30 is closed. The barrier doors 36, 37 may not open completely when inserting waste into the flexible pail 10. That is, the barrier doors 36, 37 may not open to the point where they meet the inside wall of the container body 60. However it is contemplated though that the barrier doors 36, 37 may be held open against the inside wall of the container body 60 through an attachment between the barrier doors 36, 37 and a complementary feature disposed on the inside wall of the container body 60. Possible attachment mechanisms include hook-and-loop, snap-fit, magnetic points of attachment, friction-fit, and the like according to this subject disclosure.

Figure 39:
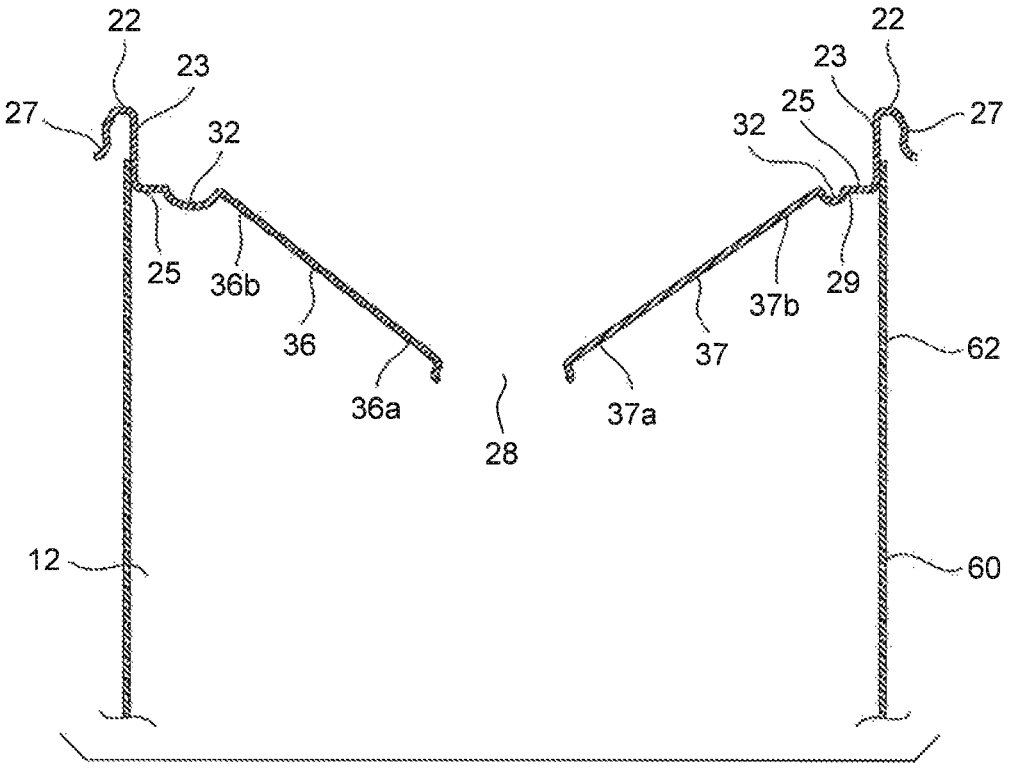
FIG. 39 is a cross-section view of the flexible pail without the lid about the line C-C shown in FIG. 35.
Figure 40:
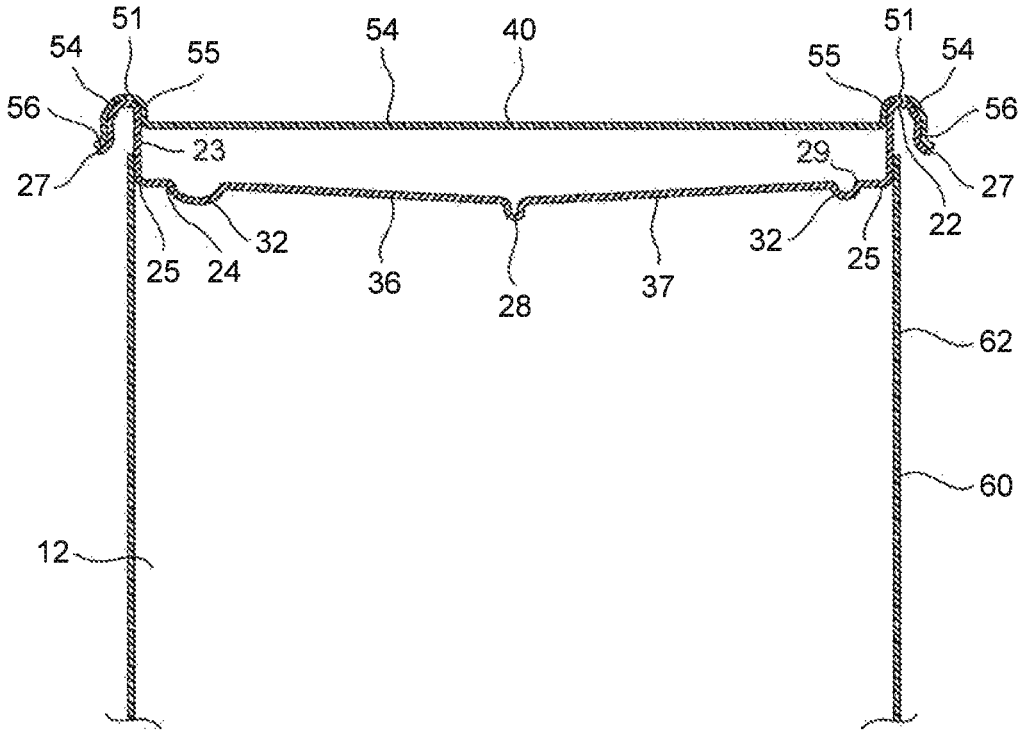
FIG. 40 is a cross-section view of the flexible pail with the lid in the closed position about the line B-B shown in FIG. 32.

As shown in FIGS. 39-40, the distal ends 36*b*, 37*b* of the barrier doors 36, 37 abut at the inner point of the barrier recesses 32. The barrier recesses 32 are substantially U-shaped in cross-section. However, it is contemplated that the barrier recesses 32 may adopt similar cross sections such as substantially V-shaped, substantially W-shaped, substantially rectangular, and the like. The barrier recesses 32 may also be inverted to yield cover ribs 21 (as shown in FIGS. 23-26). The cover ribs 21 provide additional structure and stability to prevent deformation of the cover 20 during delivery, repeated use and other similar situations.

As shown in FIGS. 39-40, the outermost boundary of the barrier recesses 32 is the edge 29 that transitions into the interior perimeter 25 that surrounds the barrier 30. The interior perimeter 25 borders the interior wall 23 of the cover 20 that forms the inner face of the cover lip 22. As shown in FIG. 40, the cover lip 22 mates with the lid recess 41 of the lid 40 in order to securely seal the flexible pail 10 in the closed position. The cover lip 22 may transition into an outer perimeter 27 that surrounds the entire cover 20.

FIG. 41 is a side view of the flexible pail 10 with the cover 20 attached to the container body 60 and the lid 40 in an open position. The foot pad 85 may be weighted to act as a counterbalance when the lid 40 is fully extended in the open position. A counterbalance to help maintain the balance of the flexible pail 10 may also be disposed on the container body 60 or the cover 20. It is contemplated that a kickstand (not shown) may be provided on the rear side 13 of the flexible pail 10 to help preserve balance. The kickstand may be an additional rigid component or an extension of the container body 60, cover 20 or base 80 that pivots open and against the ground to provide stability. The flexible material that makes up the container body 60 may also have internal support elements (not shown) therein, such as reinforced seams, wires, or other semi-rigid structure to increase stability. The lid 40 may also have support features or restraints that prevent the lid 40 from opening past a set angle, such as 90 degrees from the cover 20. The foot pad 85 or the bottom surface of the base 80 may include an adhesive to secure the flexible pail 10 to a surface.

The container body 60 may also be adapted for use with a stability blade/insert (not shown). The stability blade may be inserted into a pocket that runs along the length of the outer or inner portion of the container body 60. The stability blade may also extend upward from the base 80 or downward from the cover 20. The stability blade acts as a spine that helps to maintain the upright structure of the flexible pail 10 in use.

As shown in FIG. 41, the foot pad 85 extends from the base 80 on the front side of the flexible pail 10. However, it is contemplated that the foot pad 85 may extend from the lower end 64 of the container body 60 or the base 80 from any side of the flexible pail 10. It is also contemplated that the foot pad 85 may extend along an entire length of a side of the flexible pail 10 or the foot pad 85 may extend around the entire perimeter of the flexible pail 10.

Figure 42:
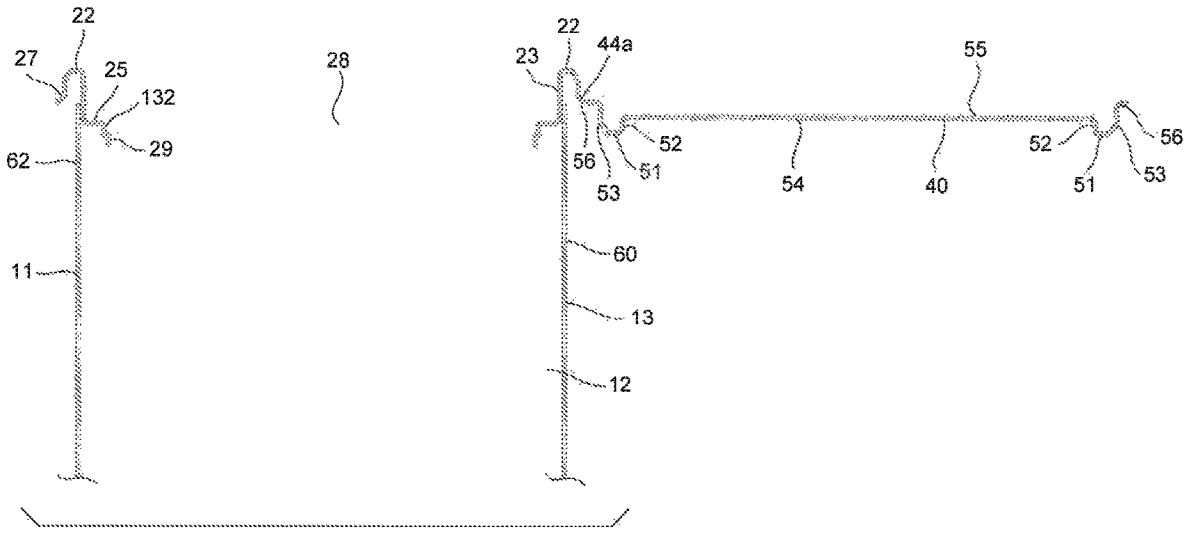
FIG. 42 is a cross section view of the flexible pail about the line A-A as shown in FIG. 31.

FIG. 42 is a cross-section of the upper end 62 of the flexible pail 10 about the line A-A shown in FIG. 31 without the scoop 17 or the barrier 30 disposed in the cover 20. As shown in FIG. 42, the interior perimeter 25 of the cover 20 may transition inward to a shoulder 132 that may terminate at the edge 29. The shoulder 132 provides additional flexibility to the cover 20 or the barrier 30 so that a user may more easily push through the barrier 30 to deposit waste into the interior chamber 12. The step in the shoulder 132 adds to the strength of the cover 20 or barrier 30 and prevents degradation of the barrier 30 due to the repetitive movement of the barrier doors 36, 37.

FIG. 42 also shows the structure of the lid 40. The cover 20 is joined to the lid 40 through the living hinge 44*a* that may extend directly from the cover lip 22 or the outer perimeter 27. The living hinge 44*a* is connected to the lid perimeter surface 56 disposed on the outer surface 54 of the lid 40. The lid perimeter surface 56 may extend along the boundary of the lid 40 and may include one or more of the tabs 50 (FIGS. 31-32) for assisting with the opening of the lid 40 from the cover 20. The lid perimeter surface 56 extends to the base of the outer face 53 of the raised portion 51. The raised portion 51 is the external structure that corresponds to the lid recess 41 disposed on the lid inner surface 55. The lid recess 41 mates with the cover lip 22 in order to securely seal the flexible pail 10 in a closed position. The inner surface 55 of the raised portion 51 extends from the peak of the raised portion 51 towards the center of the lid 40.

Figure 43:
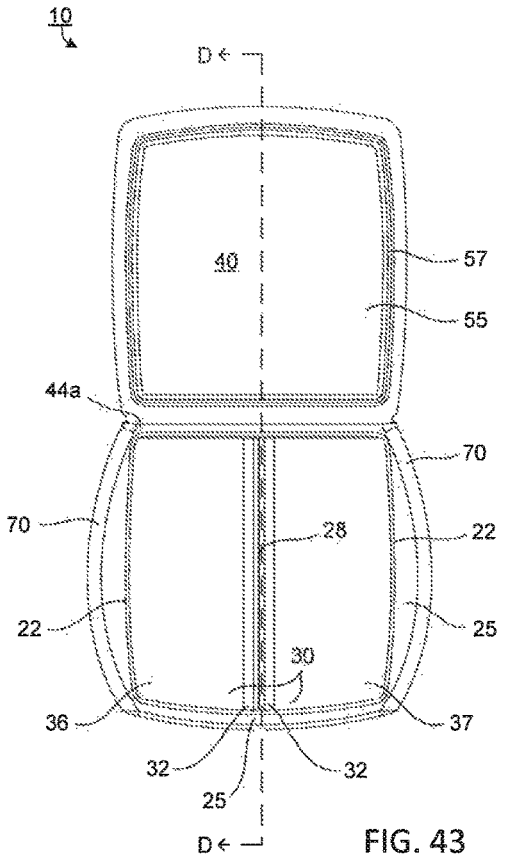
FIG. 43 is a top view of the flexible pail with the lid in the open position.
Figure 44:
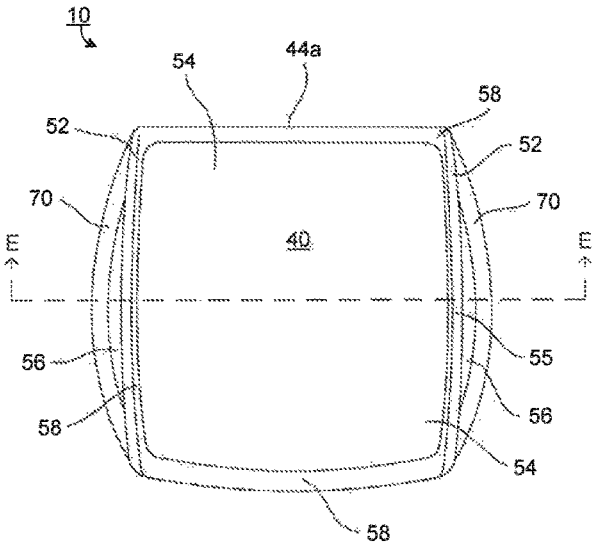
FIG. 44 is a top view of the flexible pail with the lid in the closed position.
Figure 45:
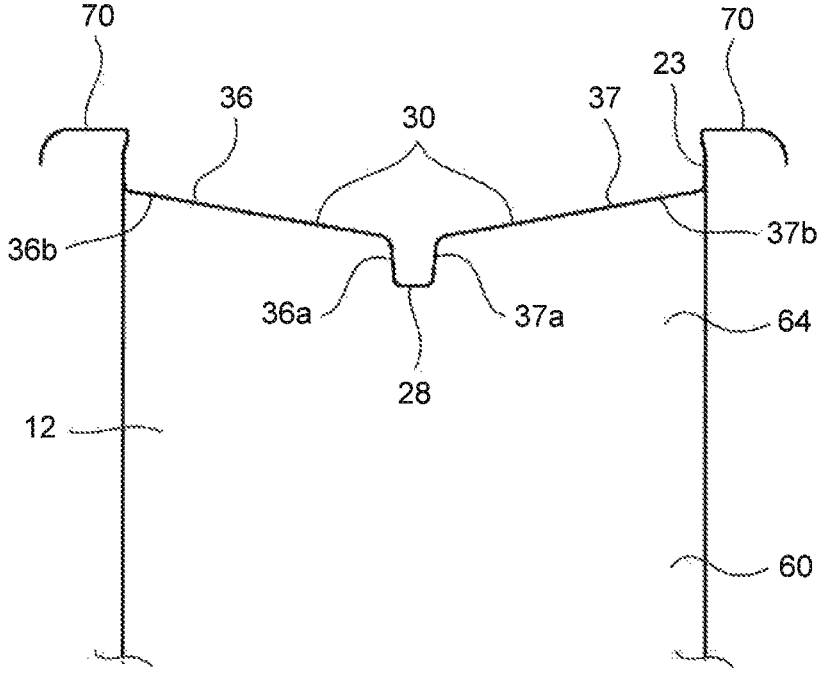
FIG. 45 is a cross-section view of the flexible pail without the lid.

FIG. 43 shows a top view of the flexible pail 10 with the lid 40 in the open position. FIGS. 43-45 show a more pronounced version of the handles 70 extending from the cover 20. The handles 70 allow the user to easily move and position the flexible pail 10. The handles 70 also afford the user greater leverage when opening the flexible pail 10 without the foot pad 85. As shown in FIG. 43, the barrier recesses 32 may be disposed at the proximate ends 36*a*, 37*a* of the barrier doors 36, 37.

Figure 46:
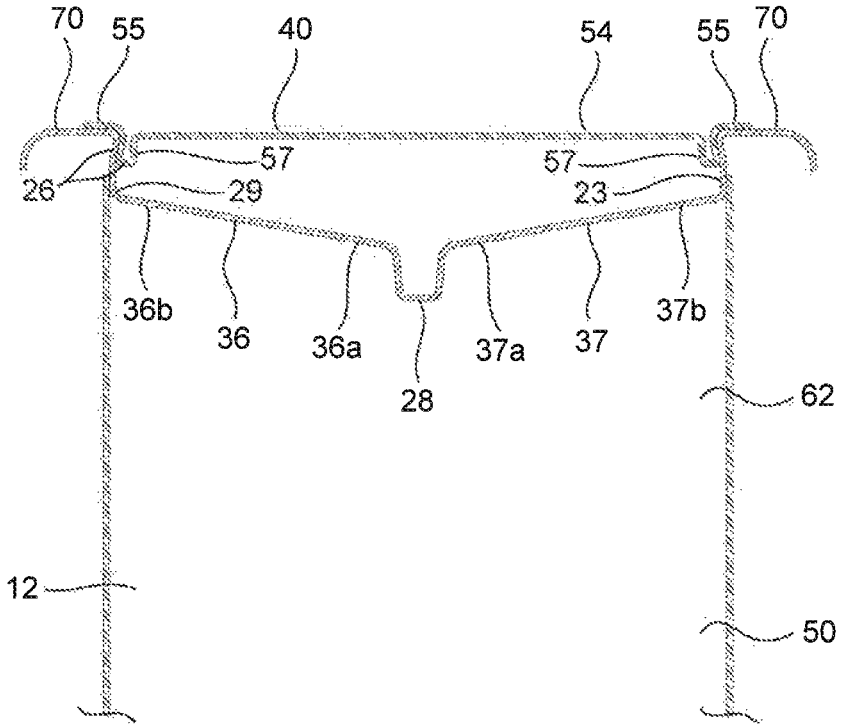
FIG. 46 is a cross-section view of the flexible pail with the lid in the closed position about the line EE as shown in FIG. 44.

In FIGS. 43-47, the structure of the sealing mechanism 19 is reversed such that a downward projecting portion 57 of the inner surface 55 of the lid 40 is secured against the inner wall 23 of the cover 20 through a friction fit. This configuration is best seen in the cross-sections of FIGS. 46-47. FIG. 46 is a cross-section about the line E-E shown in FIG. 44, while FIG. 47 is a cross-section about the line D-D shown in FIG. 43.

As shown in FIGS. 46-47, the sealing mechanism 19 is made up of the downward projecting portion 57 of the lid 40 secured against the interior wall 23 of the cover 20. In this configuration, the outer surface 54 of the lid 40 has an external recessed portion 58 that corresponds to the downward projecting portion 57 on the inner surface 55 of the lid 40. The barrier recesses 32 and the interior perimeter 25 are not shown in FIGS. 46-47, therefore the barrier doors 36, 37 abut against the interior wall 23 of the cover 20. The edge 29 forms the junction between the barrier doors 36, 37 and the inner wall 23. The handles 70 extend directly from the interior wall 23 of the cover 20. The lid perimeter surface 56 extends partially over the handles 70 in order to properly seal the lid 40 to the cover 20. However, the lid perimeter surface 56 may be substantially the same size as the handles 70 in order to increase the strength and rigidity of the handles 70 when lifting the flexible pail 10 at full capacity.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiments which are described, but is intended to cover all modifications and changes within the scope and spirit of the invention,

What is claimed:

1. A flexible waste pail, comprising:
- a compressible container comprising:
  - a container body that is flexible having a first upper end and a second lower end;
  - a cover attached to the first upper end of the container body, the cover having an opening;
  - a base attached to the second lower end of the container body;
  - a lid attached to the cover that is adapted to pivot into an open position and a closed position; and
  - at least one barrier door disposed in the opening, wherein the compressible container is adapted to stand upright.

2. The flexible waste pail in claim 1, wherein the open position is adapted to receive waste, and the closed position is adapted to seal in odor.

3. The flexible waste pail in claim 1, further comprising a hinge that connects the cover and the lid.

4. The flexible waste pail in claim 3, wherein the hinge is a living hinge.

5. The flexible waste pail in claim 1, further comprising at least one handle disposed on the cover.

6. The flexible waste pail in claim 1, further comprising a foot pad extending from the lower end of the cover or the base.

7. The flexible waste pail in claim 1, wherein the compressible container is adapted to compress and expand in height.

8. The flexible waste pail in claim 1, further comprising at least one barrier recess disposed on the cover to provide strength and resiliency to the barrier.

9. The flexible waste pail in claim 1, further comprising at least one hook disposed on the cover or container body.

10. The flexible waste pail in claim 1, wherein the cover further comprises:
- a lip bonded to the upper end of the container body; and
- a lid recess disposed on the lid that mates with the lip to seal the flexible waste pail and prevent the release of malodor.

11. The flexible waste pail in claim 1, wherein a portion of the lid extends past the cover defining a tab to be grasped in order to pull the lid away from the cover.

12. A flexible waste pail, comprising:
- a container body that is flexible having a first upper end and a second lower end;
- a cover with at least one opening attached to the first upper end of the container body;
- a base attached to the second lower end of the container body;
- a lid attached to the cover by a living hinge that is adapted to pivot into an open position and a closed position; and
- at least one barrier door disposed in the opening,
- wherein the container is compressible and adapted to stand upright.

13. The flexible waste pail in claim 12, wherein the open position is adapted to receive waste, and the closed position is adapted to seal in odor.

14. The flexible waste pail in claim 12, further comprising at least one handle on the cover or container body.

15. The flexible waste pail in claim 12, further comprising a foot pad extending from the lower end of the container body or the base.

16. The flexible waste pail in claim 12, further comprising at least one hook disposed on the cover or container body.

17. The flexible waste pail in claim 12, wherein a portion of the lid extends past the cover defining a tab to be grasped in order to pull the lid away from the cover.

18. A flexible waste pail, comprising:

a container body that is flexible and compressible having a first upper end and a second lower end;

a cover with at least one opening attached to the first upper end of the container body;

a base attached to the second lower end of the container body;

a lid attached to the cover that pivots between an open position and a closed position; and two barrier doors disposed in the opening adapted to open to receive waste into the flexible waste pail, and biased to close to seal in odor, wherein the container that is flexible and compressible is adapted to stand upright.

19. The flexible waste pail in claim 18, further comprising at least one handle on the cover or container body.

20. The flexible waste pail in claim 18, further comprising a foot pad extending from the lower end of the container body or the base.

* * * * *